US011529028B2

(12) United States Patent
Borke

(10) Patent No.: US 11,529,028 B2
(45) Date of Patent: Dec. 20, 2022

(54) SHEET PRODUCT DISPENSERS WITH REDUCED SHEET PRODUCT ACCUMULATION AND RELATED METHODS

(71) Applicant: GPCP IP HOLDINGS LLC, Atlanta, GA (US)

(72) Inventor: Brian Scott Borke, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 16/778,807

(22) Filed: Jan. 31, 2020

(65) Prior Publication Data

US 2020/0163497 A1 May 28, 2020

Related U.S. Application Data

(62) Division of application No. 15/251,731, filed on Aug. 30, 2016, now Pat. No. 10,548,437.

(60) Provisional application No. 62/211,917, filed on Aug. 31, 2015.

(51) Int. Cl.

| | |
|---|---|
| ***A47K 10/36*** | (2006.01) |
| ***A47K 10/42*** | (2006.01) |
| *A47K 10/38* | (2006.01) |

(52) U.S. Cl.

CPC ..... *A47K 10/3656* (2013.01); *A47K 10/3612* (2013.01); *A47K 10/3643* (2013.01); *A47K 10/424* (2013.01); *A47K 10/3637* (2013.01); *A47K 2010/3881* (2013.01)

(58) Field of Classification Search

CPC ..... A47K 10/3612; A47K 10/3643; A47K 10/3656; A47K 10/424; A47K 2010/3881

See application file for complete search history.

(56) References Cited

U.S. PATENT DOCUMENTS

| | | | |
|---|---|---|---|
| 2,000,099 | A | 5/1935 | Schaefer, Jr. |
| 2,153,278 | A | 4/1939 | Shelley |
| 2,369,851 | A | 2/1945 | Price |

(Continued)

FOREIGN PATENT DOCUMENTS

| | | | |
|---|---|---|---|
| FR | 2713075 | A1 | 6/1995 |
| WO | 8702294 | A1 | 4/1987 |

(Continued)

OTHER PUBLICATIONS

International Search Report and Written Opinion for International Application No. PCT/US2016/049461 dated Nov. 4, 2016, 9 pages.

*Primary Examiner* — William E Dondero

(57) ABSTRACT

A sheet product dispenser for dispensing sheet product from a supply of sheet product reduces accumulation of the sheet product in the chute. The dispenser comprises a housing including a chute having a sheet product dispensing opening, a sheet product feed roller assembly disposed in the housing and configured to feed sheet product from the supply of sheet product into the chute, and a pusher disposed in the housing and configured to engage the sheet product fed from the sheet product feed roller assembly at a location downstream from the sheet product feed roller assembly and push the sheet product fed from the sheet product feed roller assembly toward the dispensing opening to reduce accumulation of the sheet product in the chute. A related method of reducing accumulation of the sheet product in the chute also is provided.

18 Claims, 24 Drawing Sheets

(56) References Cited

U.S. PATENT DOCUMENTS

| | | | |
|---|---|---|---|
| 2,830,810 | A | 4/1958 | Colburn |
| 3,971,607 | A | 7/1976 | Schnyder |
| 4,067,509 | A | 1/1978 | Graham, Jr. |
| 4,186,633 | A | 2/1980 | Baumann |
| 4,358,169 | A | 11/1982 | Filipowicz |
| 4,432,261 | A | 2/1984 | Deluca |
| 4,611,768 | A | 9/1986 | Voss |
| 4,635,837 | A | 1/1987 | Granger |
| 4,712,461 | A | 12/1987 | Rasmussen |
| 4,817,483 | A | 4/1989 | Armbruster |
| 5,048,386 | A | 9/1991 | Deluca |
| 5,078,033 | A | 1/1992 | Formon |
| 5,271,574 | A | 12/1993 | Formon |
| 5,441,189 | A | 8/1995 | Formon |
| 5,979,284 | A | 11/1999 | Granger |
| 6,079,305 | A | 6/2000 | Bloch |
| 6,112,631 | A | 9/2000 | Vanalstine |
| 6,314,850 | B1 | 11/2001 | Morand |
| 6,354,533 | B1 | 3/2002 | Jespersen |
| 6,363,824 | B1 | 4/2002 | Granger |
| 6,684,751 | B2 | 2/2004 | Kapiloff |
| 6,826,991 | B1 | 12/2004 | Rasmussen |
| 6,860,447 | B2 | 3/2005 | Boone |
| 7,040,566 | B1 | 5/2006 | Rodrian |
| 7,066,070 | B2 | 6/2006 | Granger |
| 7,234,381 | B2 | 6/2007 | Granger |
| 7,357,348 | B2 | 4/2008 | Kananen |
| 7,931,228 | B2 | 4/2011 | Omdoll |
| 8,146,471 | B2 | 4/2012 | Hansen |
| 8,220,684 | B1 | 7/2012 | Keily |
| 8,282,033 | B2 | 10/2012 | Achton |
| 8,998,055 | B2 | 4/2015 | Henson et al. |
| 2002/0033405 | A1 | 3/2002 | Gergek |
| 2003/0164079 | A1 | 9/2003 | Budz |
| 2004/0129824 | A1 | 7/2004 | Granger |
| 2010/0319508 | A1 | 12/2010 | Hagleitner |
| 2012/0241548 | A1 | 9/2012 | Rozek |
| 2014/0116216 | A1 | 5/2014 | Morand |
| 2015/0082960 | A1 | 3/2015 | Niada |

FOREIGN PATENT DOCUMENTS

| | | | |
|---|---|---|---|
| WO | 9523677 | A1 | 9/1995 |
| WO | 9927833 | A1 | 6/1999 |
| WO | 02072320 | A1 | 9/2002 |
| WO | 03013332 | A1 | 2/2003 |
| WO | 03051166 | A1 | 6/2003 |
| WO | 2009150197 | A1 | 12/2009 |
| WO | 2013164723 | A1 | 11/2013 |
| WO | 2014064357 | A1 | 5/2014 |

SHEET PRODUCT DISPENSERS WITH REDUCED SHEET PRODUCT ACCUMULATION AND RELATED METHODS

CROSS-REFERENCE TO RELATED APPLICATIONS

This application is a divisional application claiming priority to U.S. patent application Ser. No. 15/251,731 filed Aug. 30, 2016, which claims priority to U.S. Provisional Application No. 62/211,917, filed Aug. 31, 2015, the disclosure of which is are incorporated herein by reference.

FIELD OF THE DISCLOSURE

The present disclosure relates generally to sheet product dispensers and more particularly to sheet product dispensers that dispense sheet product through a chute to a dispenser opening for access by the user and related methods.

BACKGROUND

Various types of sheet product dispensers are known in the art, including mechanical and automated dispensers configured to allow a user to obtain a length of sheet product from a roll of sheet product disposed within the dispenser. Sheet product dispensers generally are configured to dispense a particular type of sheet product, such as bath tissue, facial tissue, wipes, napkins, paper towels, foils, wraps, or the like. Additionally, sheet product dispensers often are configured for use in a certain environment, such as a home, commercial, industrial, or medical environment, taking into account the operating conditions, expected user traffic, and distinct performance requirements. For example, in some medical or clean manufacturing environments, such as the patient rooms of hospitals or other medical, laboratory, or manufacturing facilities, user traffic at the dispenser may be relatively low, but performance requirements of the dispenser may be great, due at least in part to an increased need for hygienic operation as well as efficiency demands of personnel who wash their hands frequently.

According to certain configurations, sheet product dispensers may be automated devices configured to rotatably support the roll within the dispenser for dispensing sheet product therefrom. During operation of such dispensers, a dispensing mechanism such as a feed roller assembly inside a housing may advance a length of sheet product through a chute and out of the dispenser through a dispenser opening for a user to grasp and separate from the roll, as may be facilitated by a tear bar disposed in the dispenser housing or a predefined area of weakness, such as a line of perforations, defined in the sheet product. In this manner, during use of the dispenser, the user touches only the sheet product that is removed, while the roll remains protected within the dispenser.

Due to the flexibility of many sheet products, however, sheet product dispensed by a feed roller assembly inside a dispenser housing may buckle, bunch, and jam inside the dispenser and accumulate in the chute of the dispenser if a leading edge or any portion of the sheet product experiences sufficient resistance downstream of the feed roller assembly. Resistance may be caused by static charge, directional changes to the paper path, obstructions such as a tear bar, or other factors. If the resistance is more than the strength of the sheet product, the sheet product may buckle, and if it does, movement of the leading edge may stop, while the feed roller assembly continues to advance a trailing edge of a sheet product, thus accumulating, or bunching, the sheet product between the leading edge and the feed roller assembly. Bunching continues until the feed roller assembly stops or the leading edge of the paper is removed from the dispenser chute. Bunching can make it difficult for a dispenser user to retrieve sheet product and can also leave an undesirable perception with users. Bunching can also lead to jamming in which the dispenser is no longer able to deliver product to a user until a technician opens the dispenser and removes the jamming to restore functionality.

Thus, improved sheet product dispensers and related methods for dispensing sheet product through a dispenser chute with reduced accumulation of the sheet product in the dispenser chute are desirable.

SUMMARY

In one aspect, a sheet product dispenser for dispensing sheet product from a supply of sheet product that reduces accumulation of the sheet product in the dispenser chute is provided. The dispenser comprises a housing including a chute having a sheet product dispensing opening, a sheet product feed roller assembly disposed in the housing and configured to feed sheet product from the supply of sheet product into the chute, and a pusher disposed in the housing and configured to engage the sheet product fed from the sheet product feed roller assembly at a location downstream from the sheet product feed roller assembly and push the sheet product fed from the sheet product feed roller assembly toward the dispensing opening to reduce accumulation of the sheet product in the chute.

According to another aspect, a method of reducing accumulation of sheet product from a supply of sheet product fed into a dispenser chute is also provided. The method includes feeding a sheet product from the supply of sheet product into a chute with a sheet product feed roller assembly, and engaging the sheet product fed from the sheet product feed roller assembly at a location downstream from the sheet product feed roller assembly with a pusher disposed in the housing so as to push the sheet product fed from the sheet product feed roller assembly toward the dispensing opening to reduce accumulation of a sheet product in the chute.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

1, except no mechanism for reducing accumulation of sheet product is shown to illustrate accumulation that can occur in the chute of a dispenser.

Figure 1:
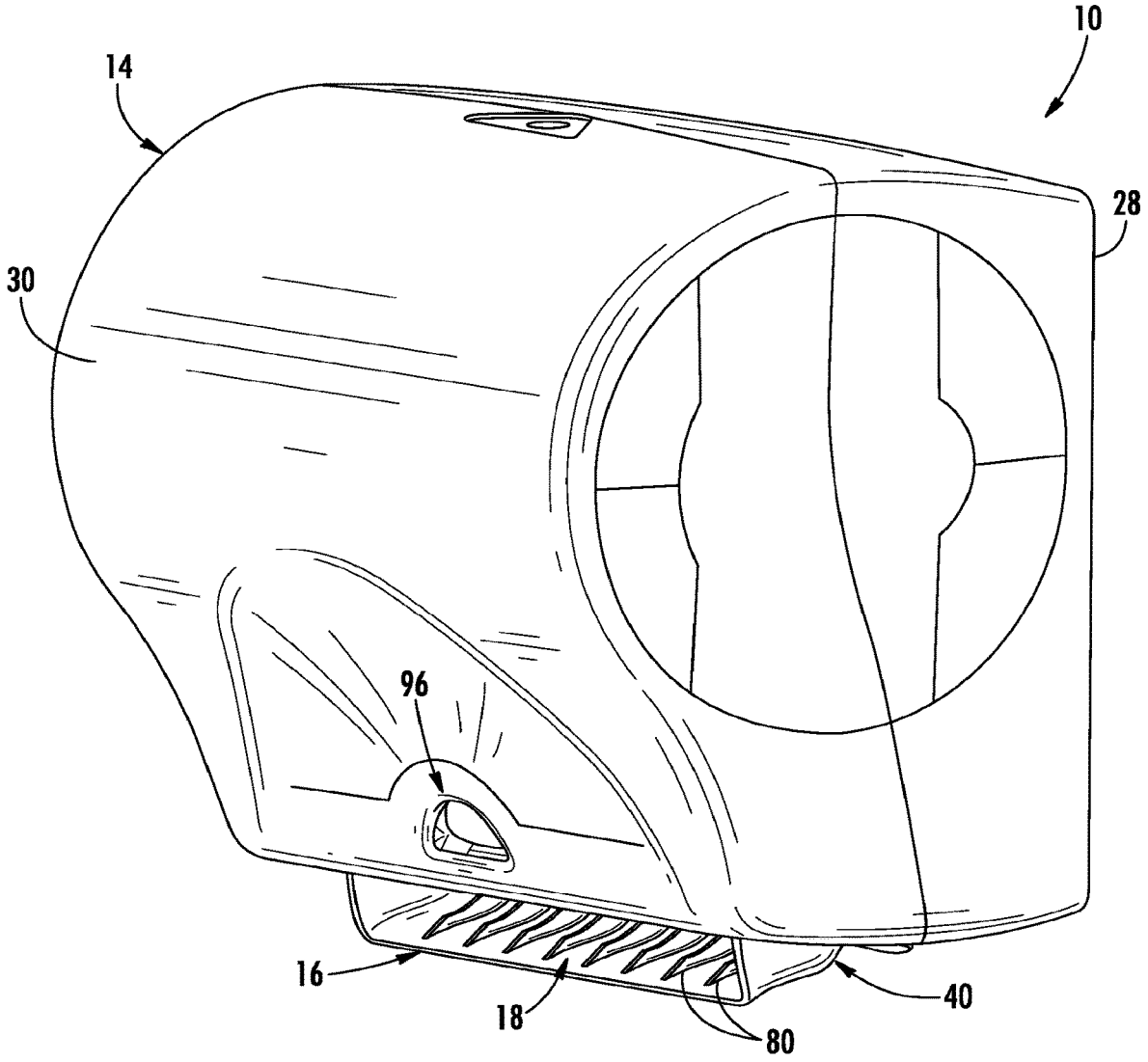
FIG. 1 is a perspective view of a sheet product dispenser in accordance with one or more embodiments of the disclosure.
Figure 4:
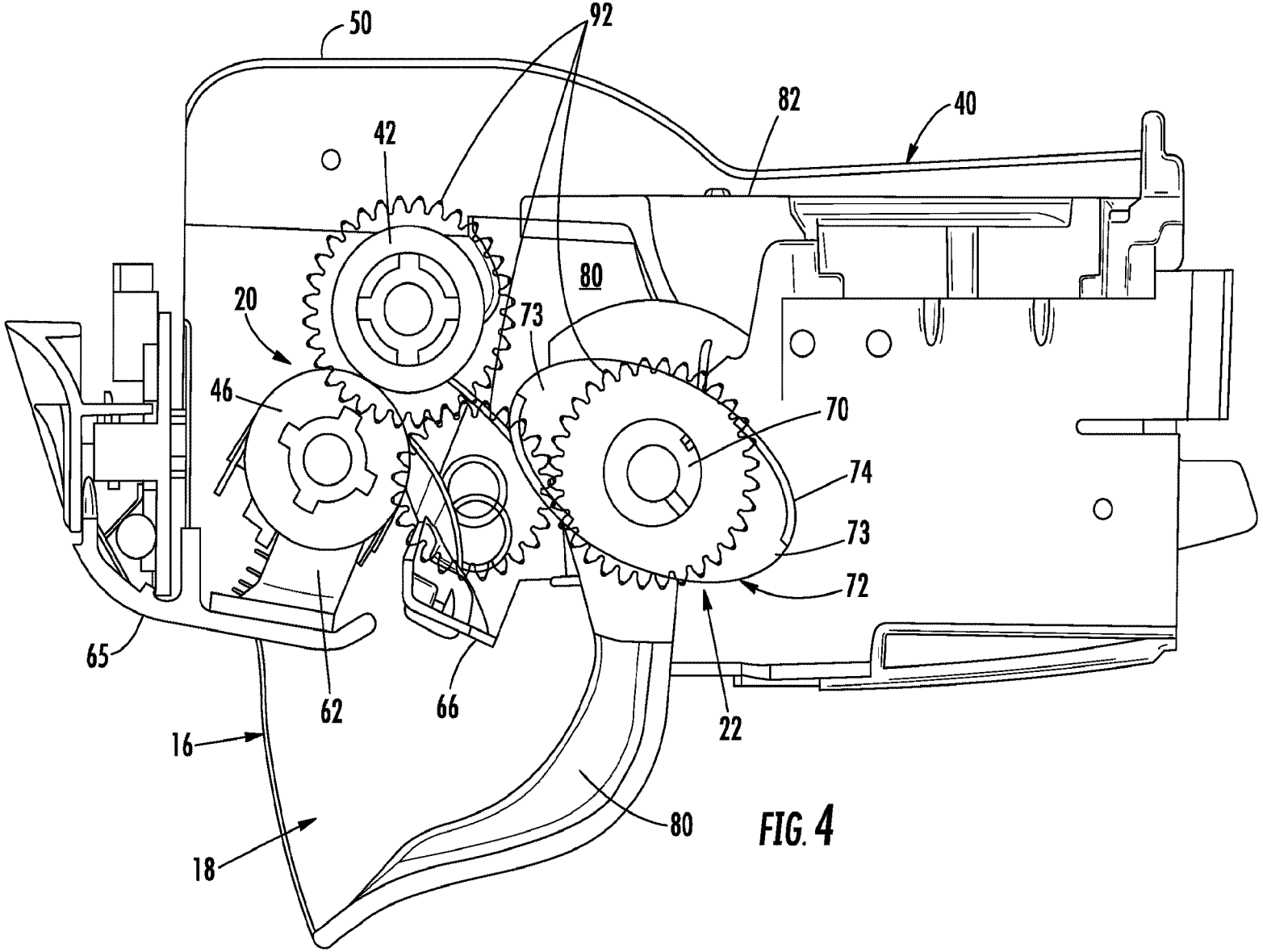

FIG. 4 is a partial side sectional view of the dispensing unit which forms a part of the sheet product dispenser in FIG. 1 illustrating a sheet product feed roller assembly and pusher with gears for their synchronization.

Figure 5A:
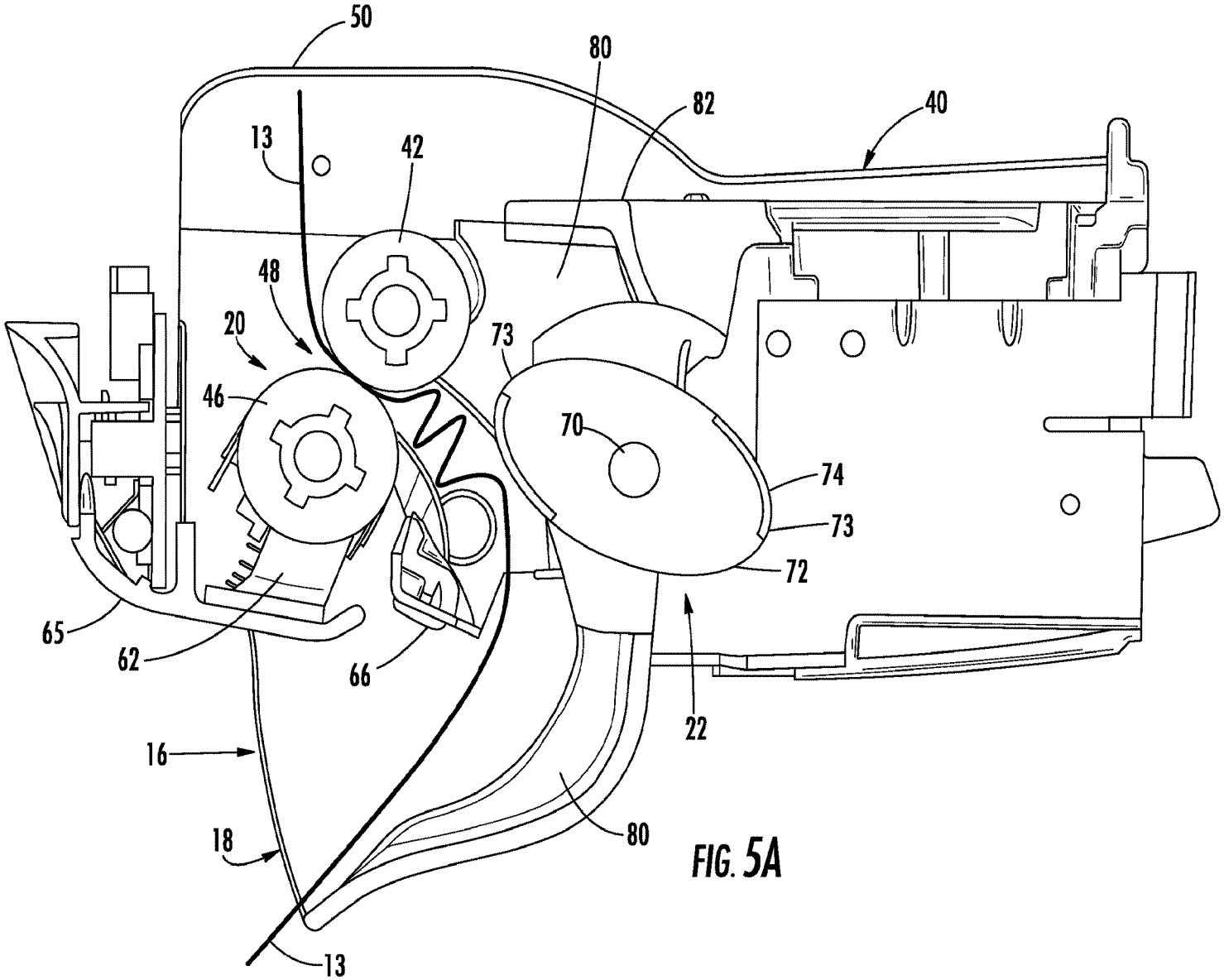

FIG. 5A is a partial sectional view of a dispensing unit which forms part of the sheet product dispenser of FIG. 1 illustrating initial accumulation of sheet product in the dispenser chute and initial action of a pusher to reduce accumulation.

Figure 5B:
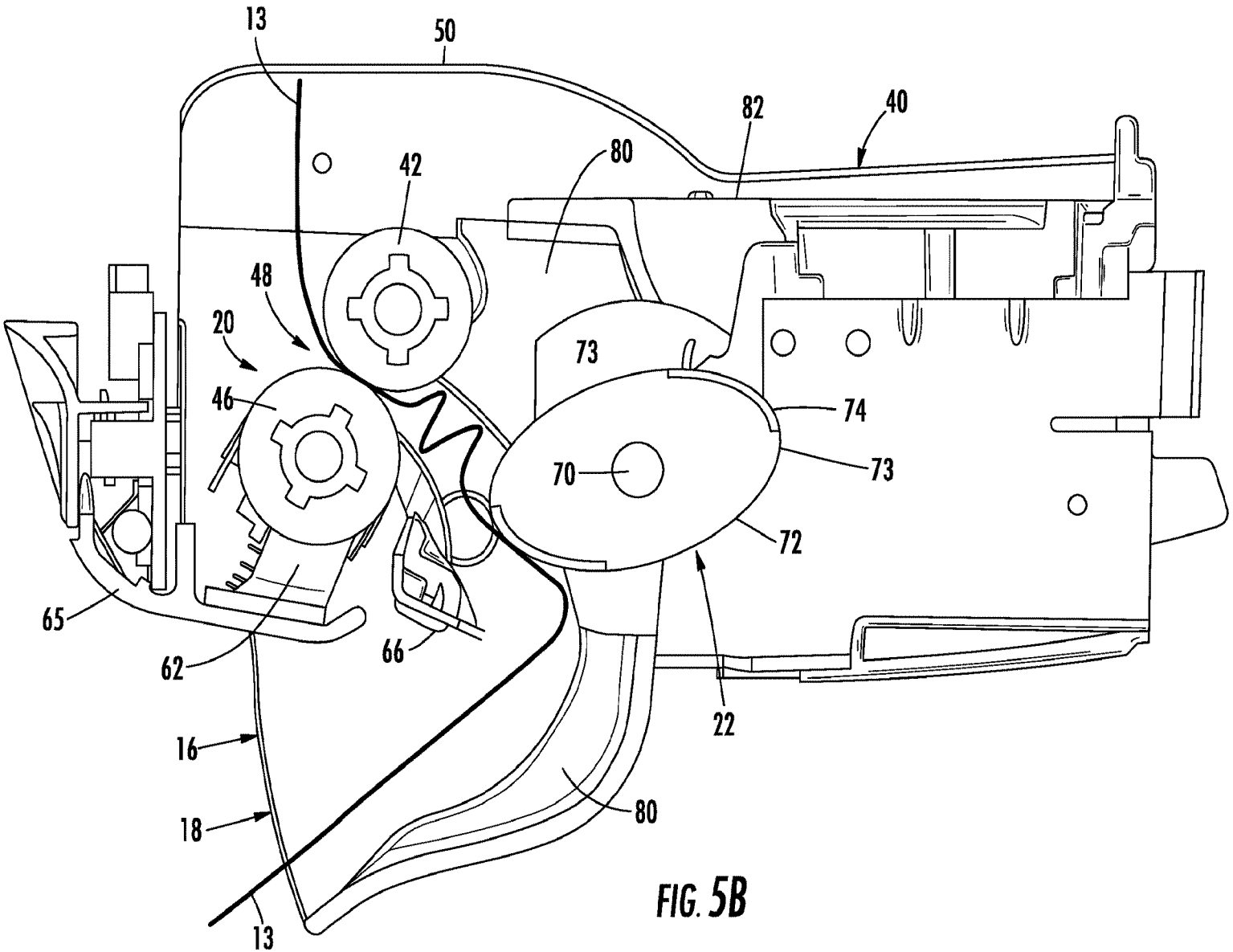

FIG. 5B is a partial side sectional view of a dispensing unit which forms part of the sheet product dispenser of FIG. 1 illustrating a pusher engaged with sheet product fed from the sheet product feed roller assembly.

Figure 5C:
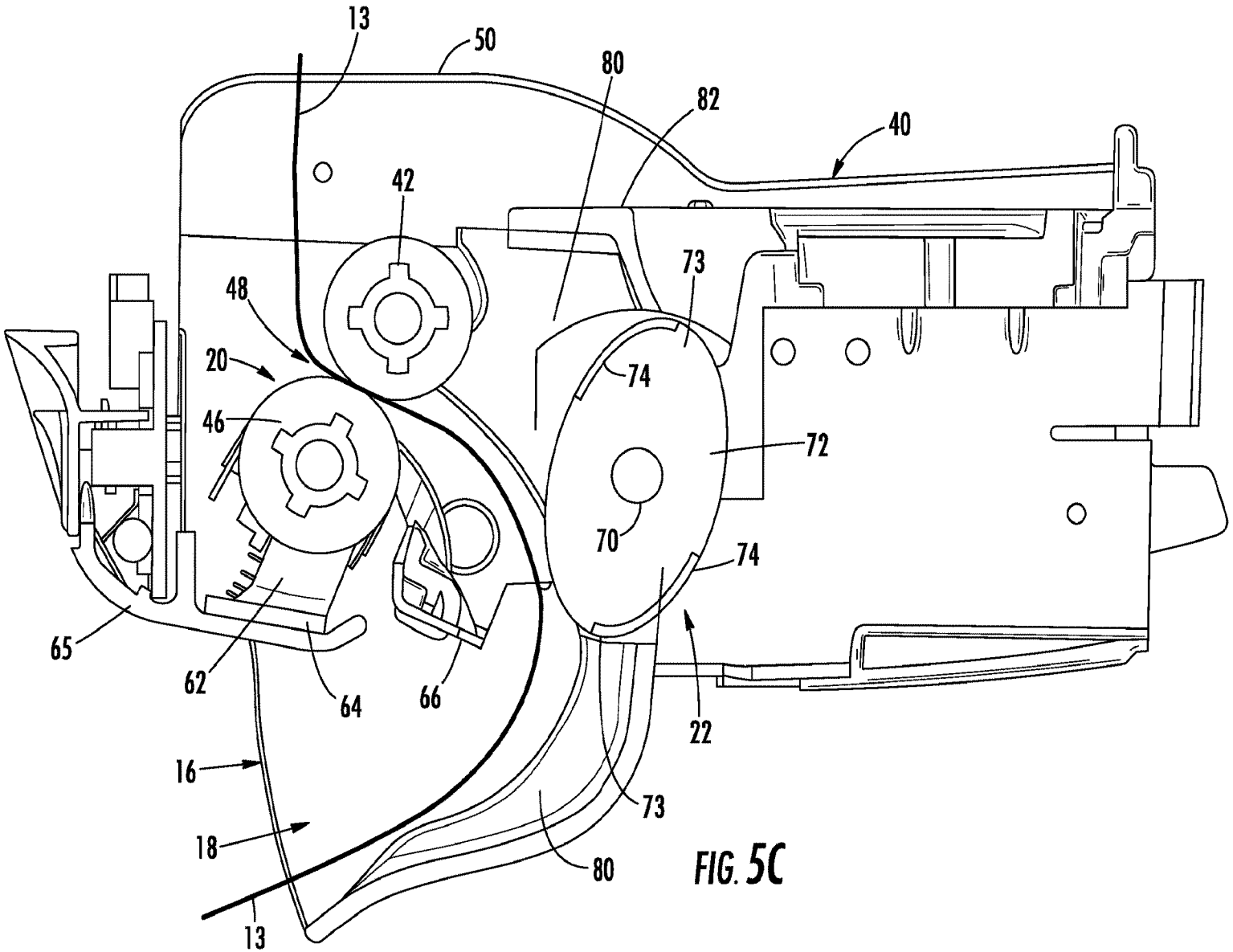

FIG. 5C is a partial side sectional view of a dispensing unit which forms part of the sheet product dispenser of FIG. 1 illustrating the pusher having reduced accumulation of the sheet product in the dispenser chute.

Figure 6A:
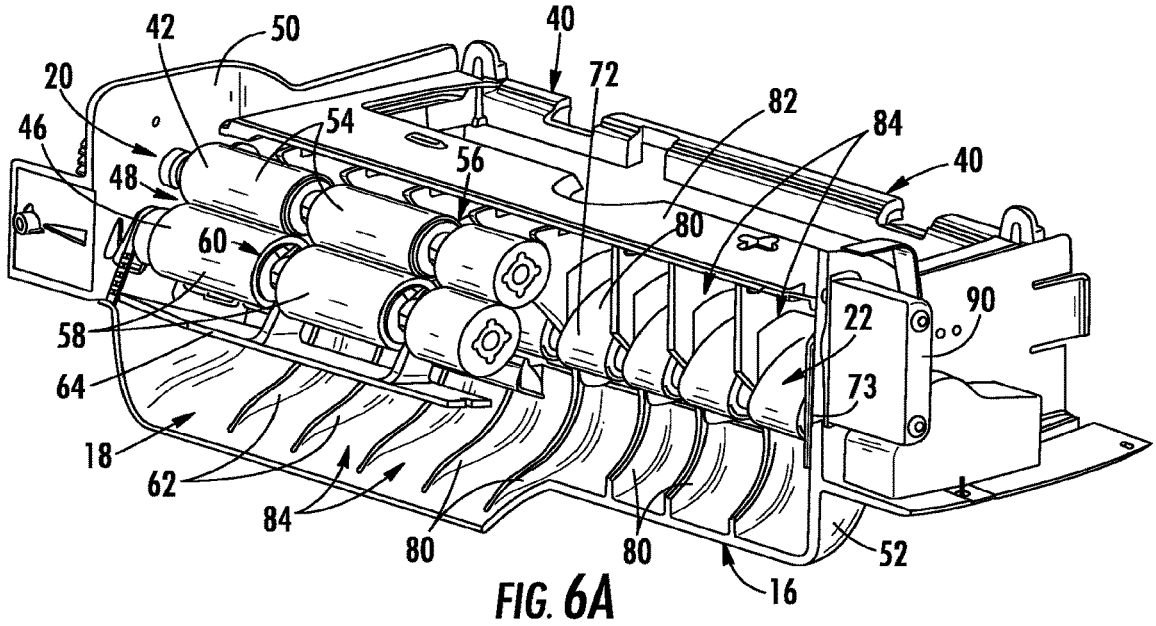

FIG. 6A is a partial sectional perspective view of the dispensing unit of the sheet product dispenser of FIG. 1.

Figure 6E:
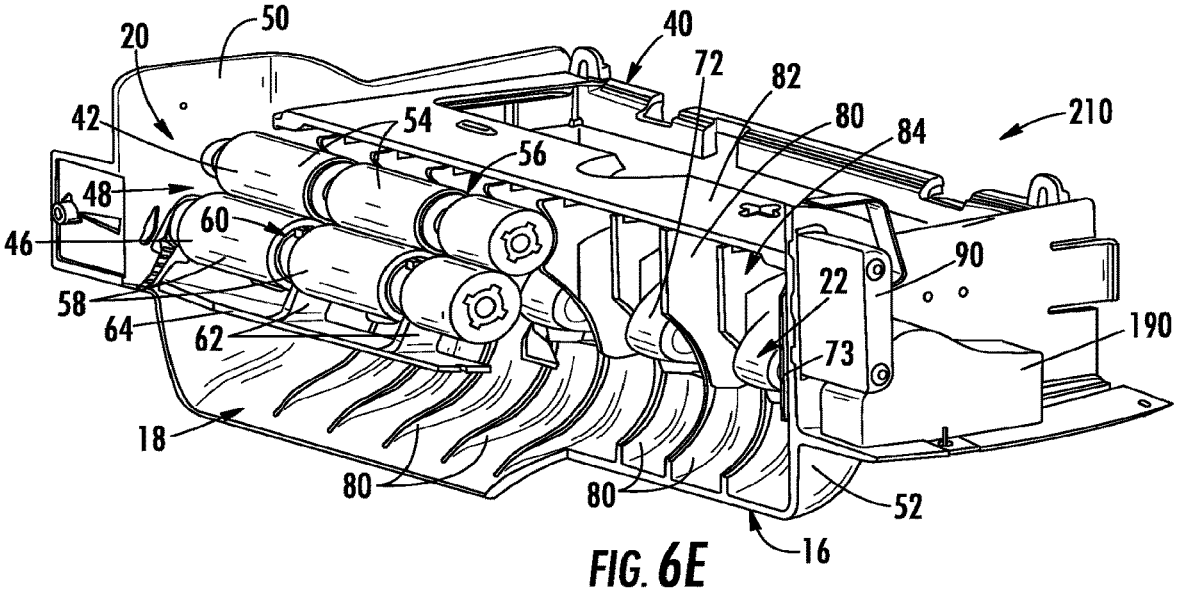
Figure 6B:
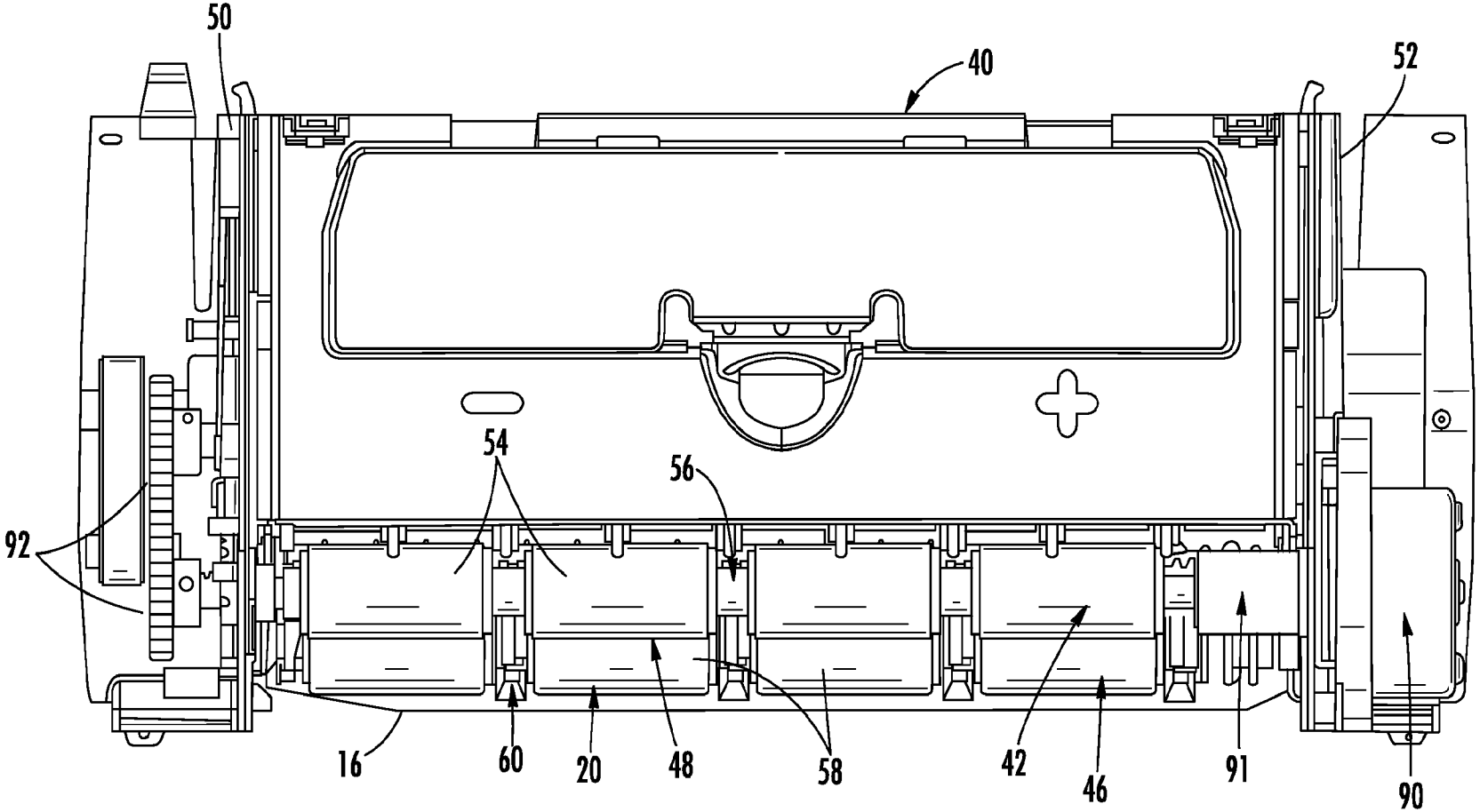

FIG. 6B is a top plan view of the dispensing unit in FIG. 6A.

Figure 6C:
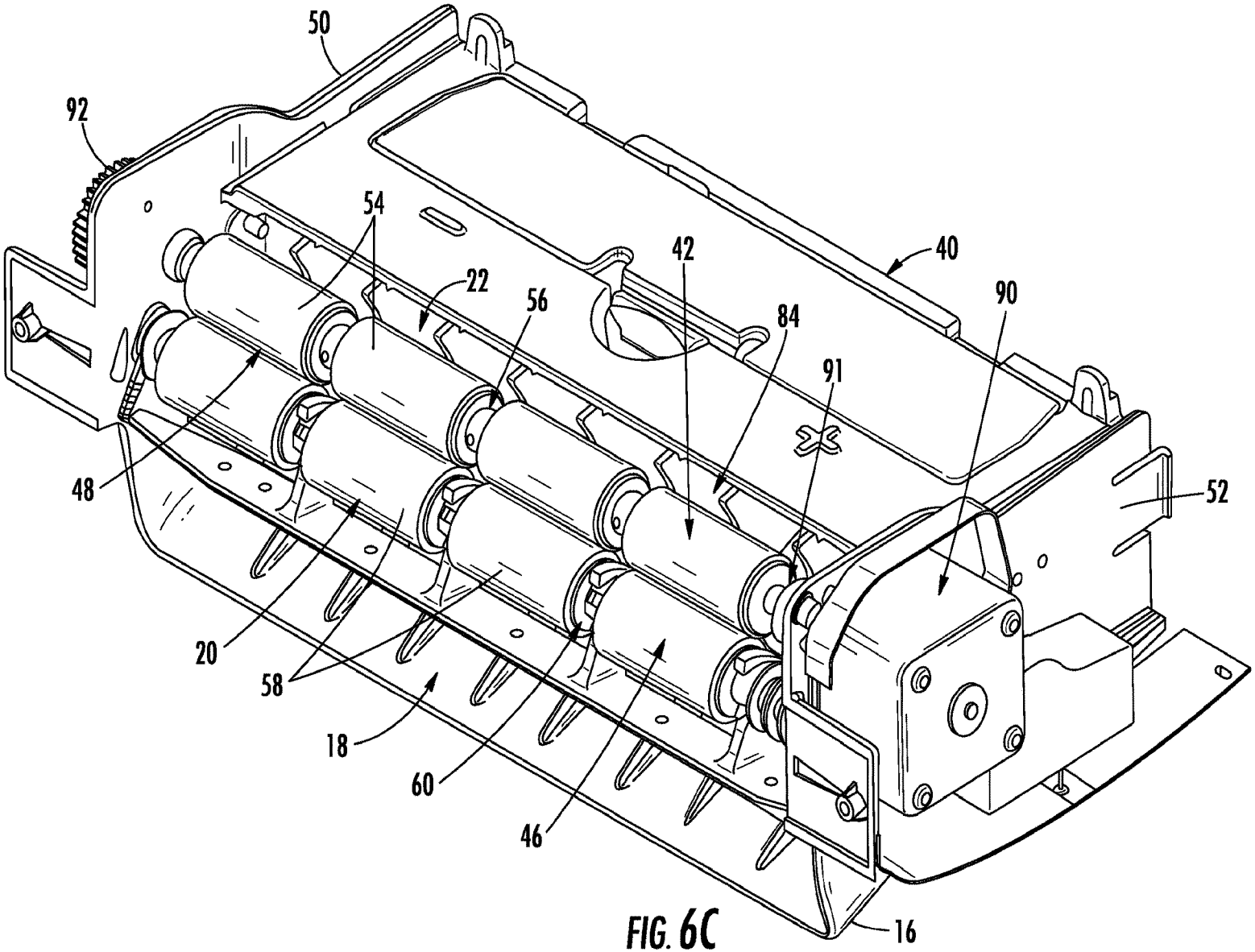

FIG. 6C is a frontal perspective view of the dispensing unit in FIG. 6A.

Figure 6D:
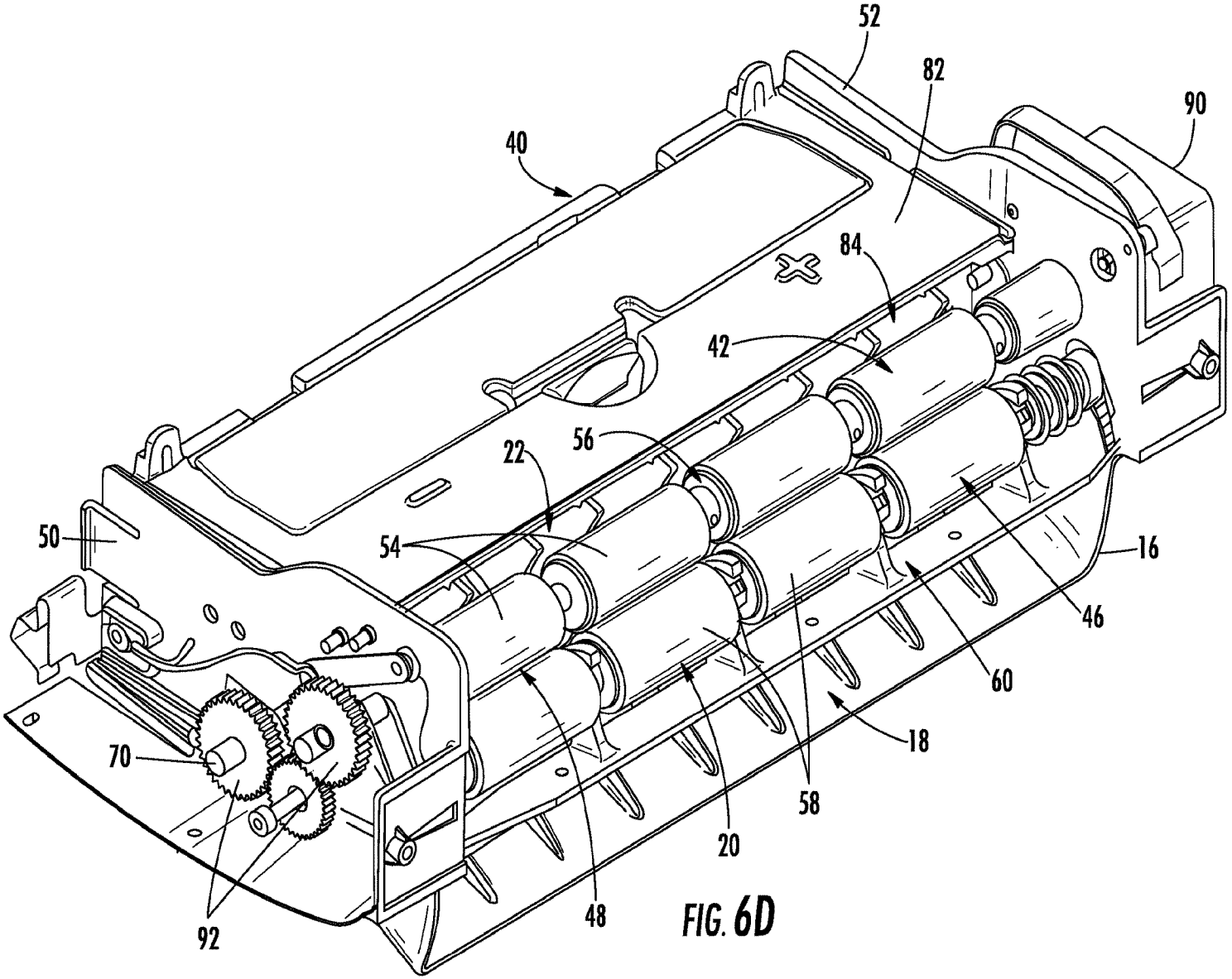

FIG. 6D is another frontal perspective view of the dispensing unit in FIG. 6A.

FIG. 6E is a partial sectional perspective view of a dispensing unit which forms part of a sheet product dispenser in accordance with another embodiment of the disclosure.

Figure 6F:
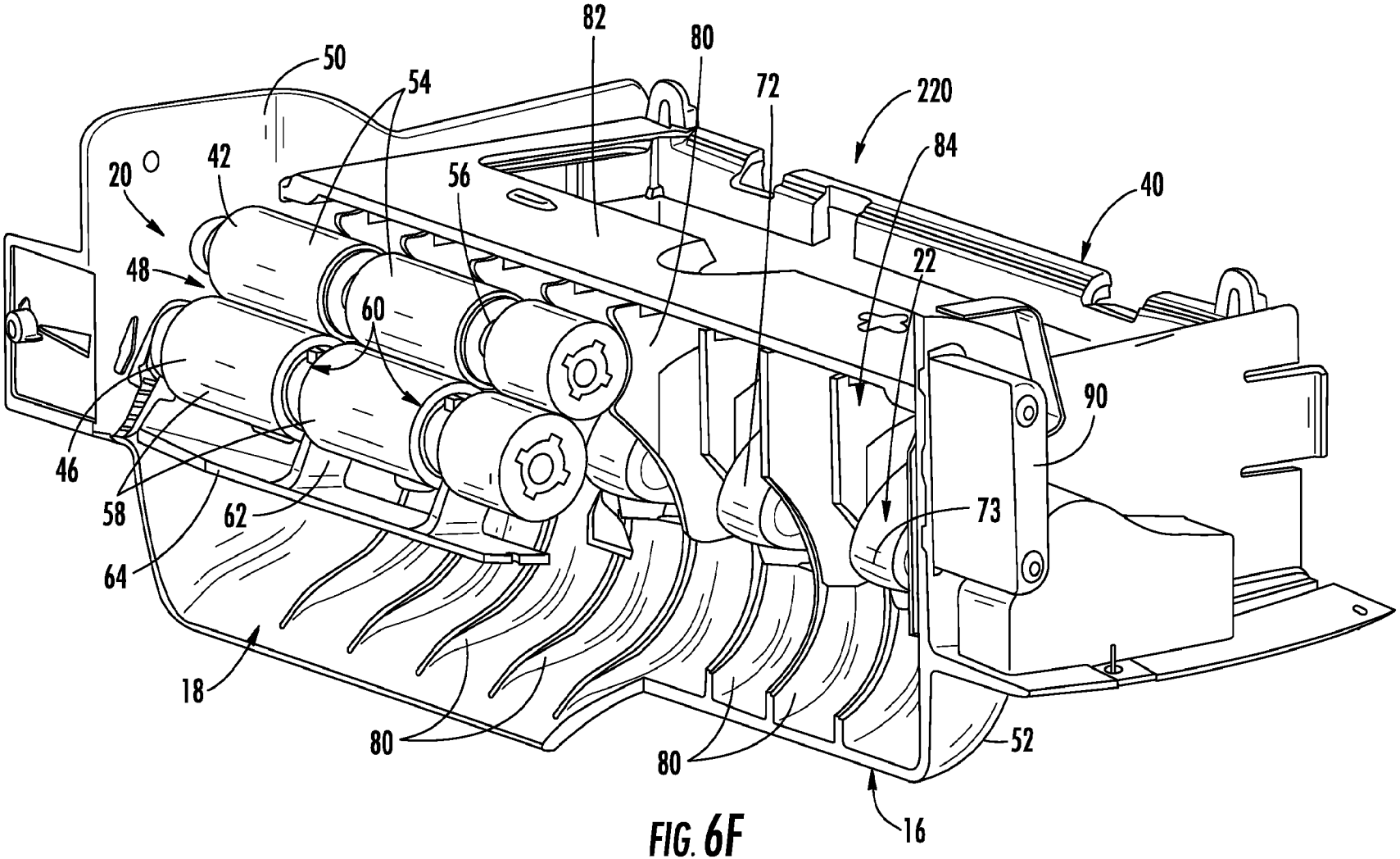

FIG. 6F is a partial sectional perspective view of a dispensing unit which forms part of a sheet product dispenser made in accordance with yet another embodiment of the disclosure.

Figure 7A:
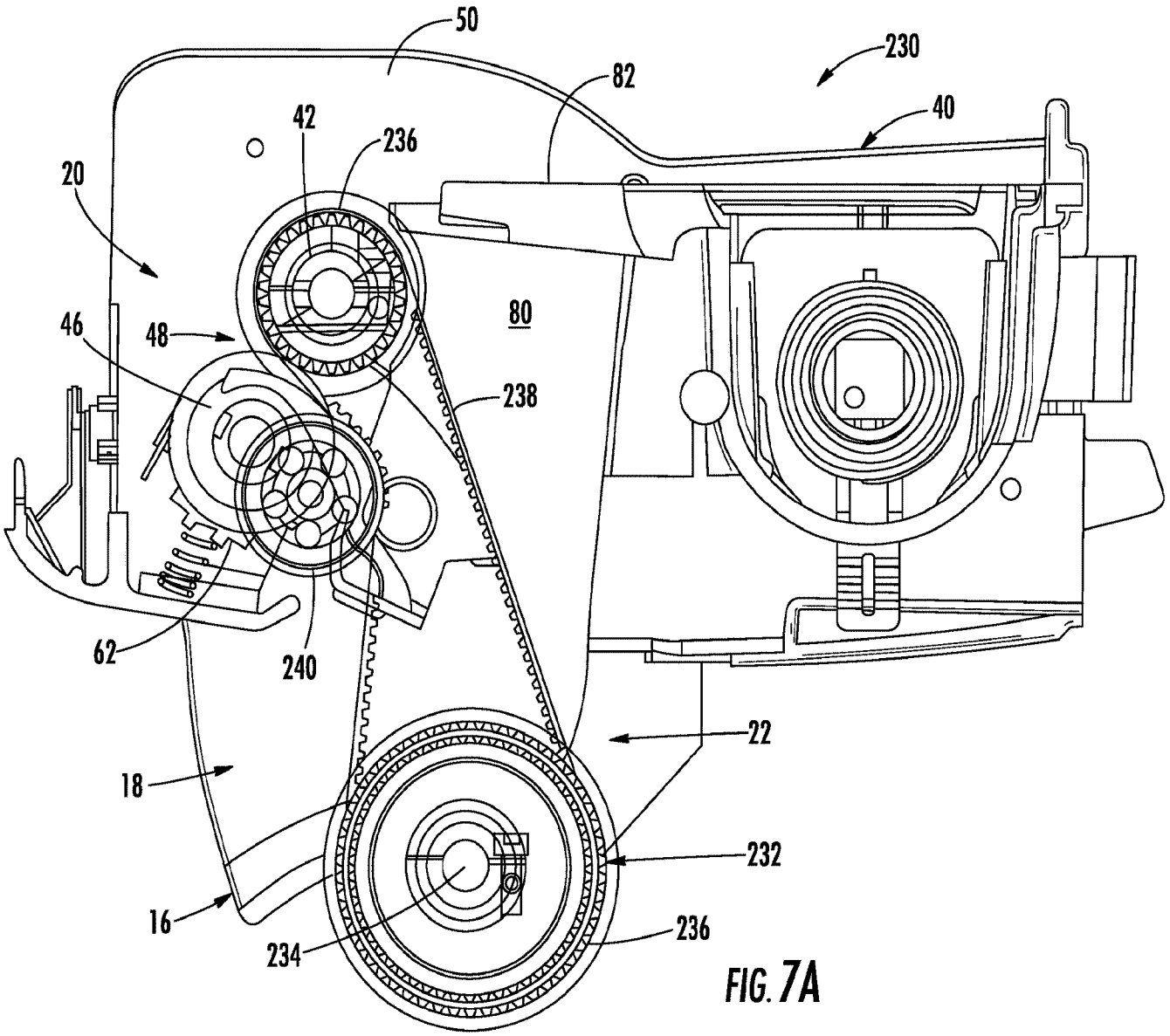

FIG. 7A is a partial sectional side view of a dispensing unit which forms part of a sheet product dispenser made in accordance with still another embodiment of the disclosure.

Figure 7B:
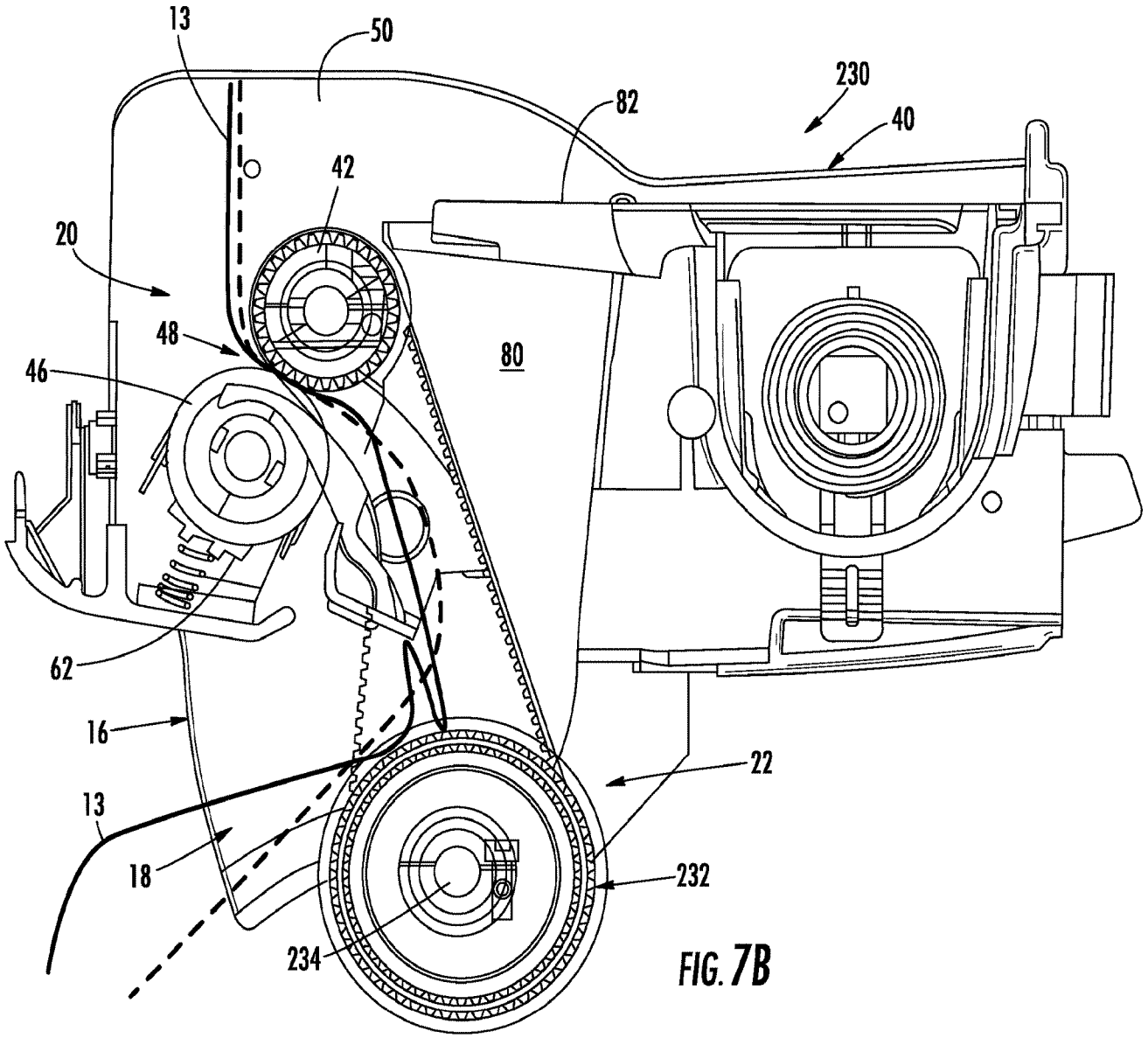

FIG. 7B is a partial side sectional view of the dispensing unit illustrated in FIG. 7A.

Figure 8:
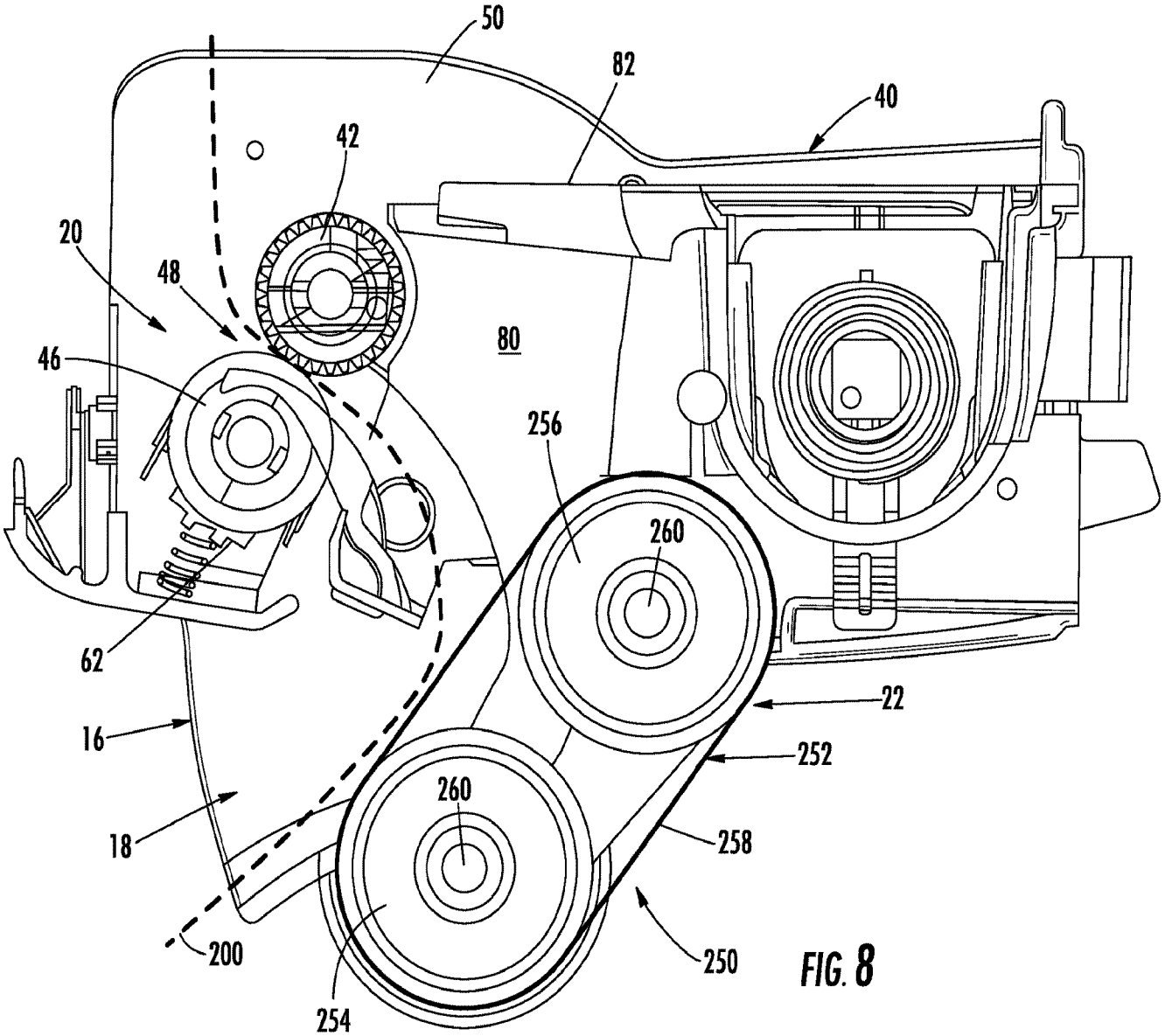

FIG. 8 is a partial side sectional view of a dispensing unit which forms part of a sheet product dispenser made in accordance with another embodiment of the disclosure.

Figure 9A:
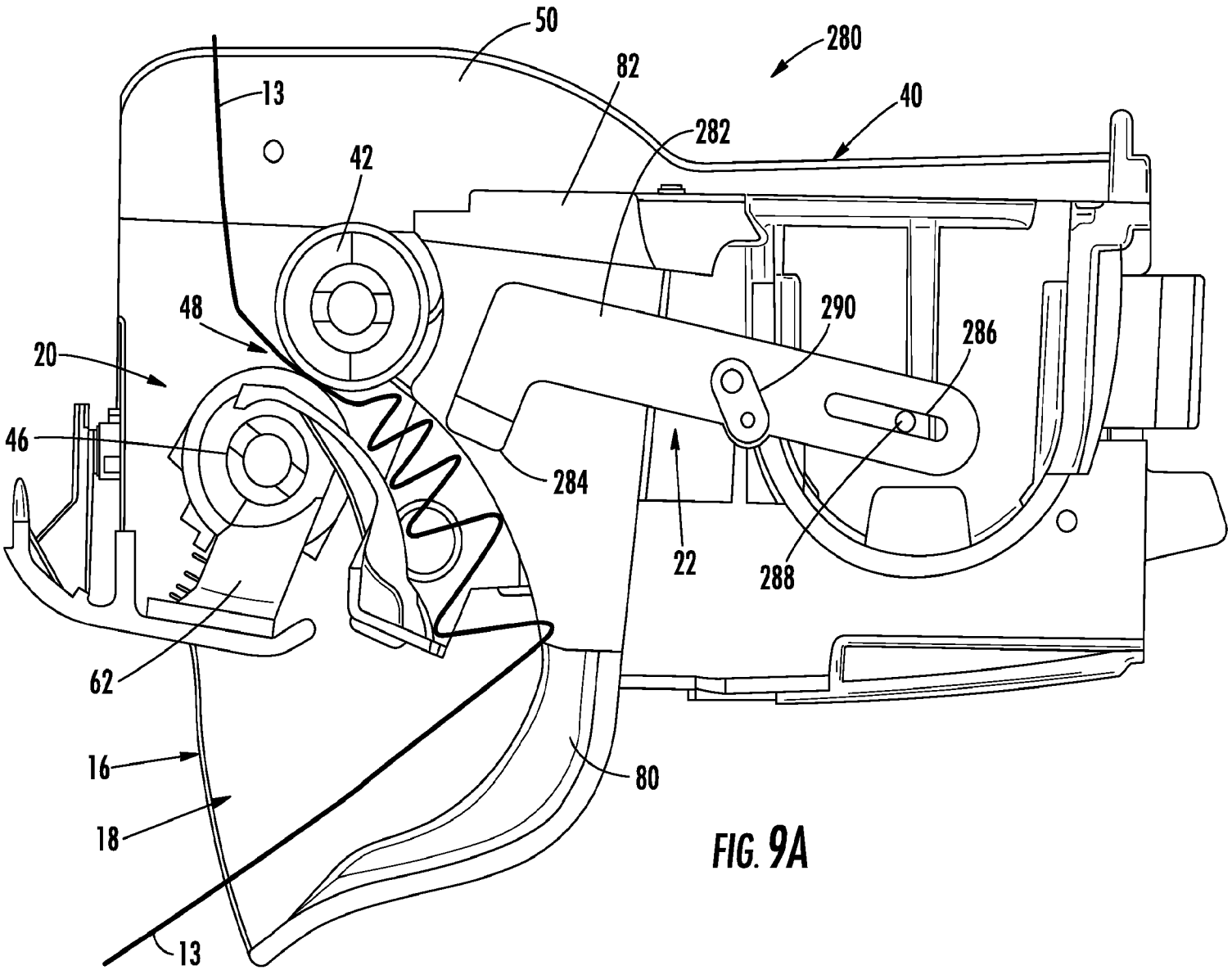

FIG. 9A is a partial side sectional view of a dispensing unit which forms part of a sheet product dispenser made in accordance with yet another embodiment of this disclosure illustrating an accumulation of sheet product in the dispenser chute.

Figure 9B:
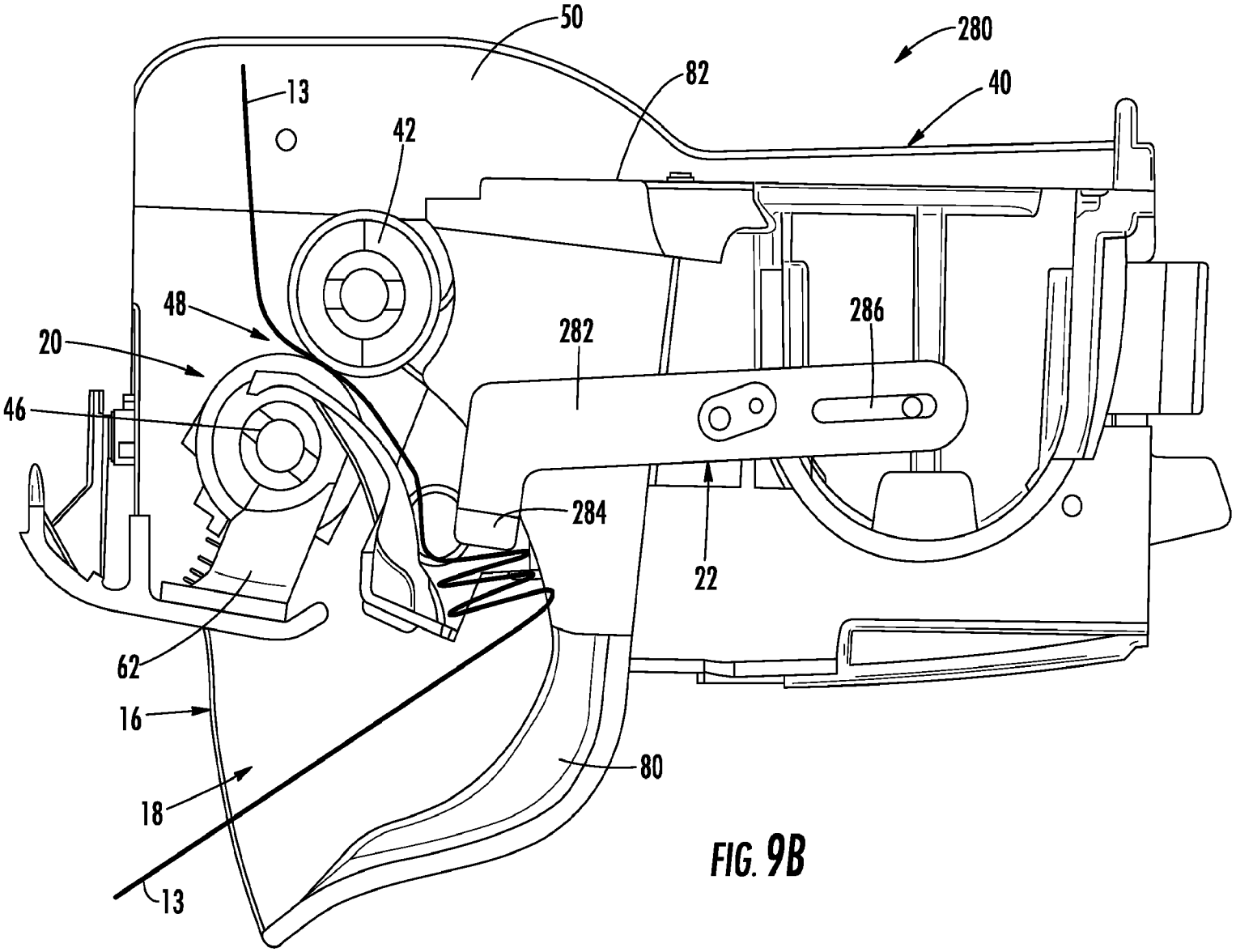

FIG. 9B is a partial sectional side view of the dispensing unit illustrated in FIG. 9A illustrating the pusher engaging the sheet product fed by the feed roller assembly.

Figure 9C:
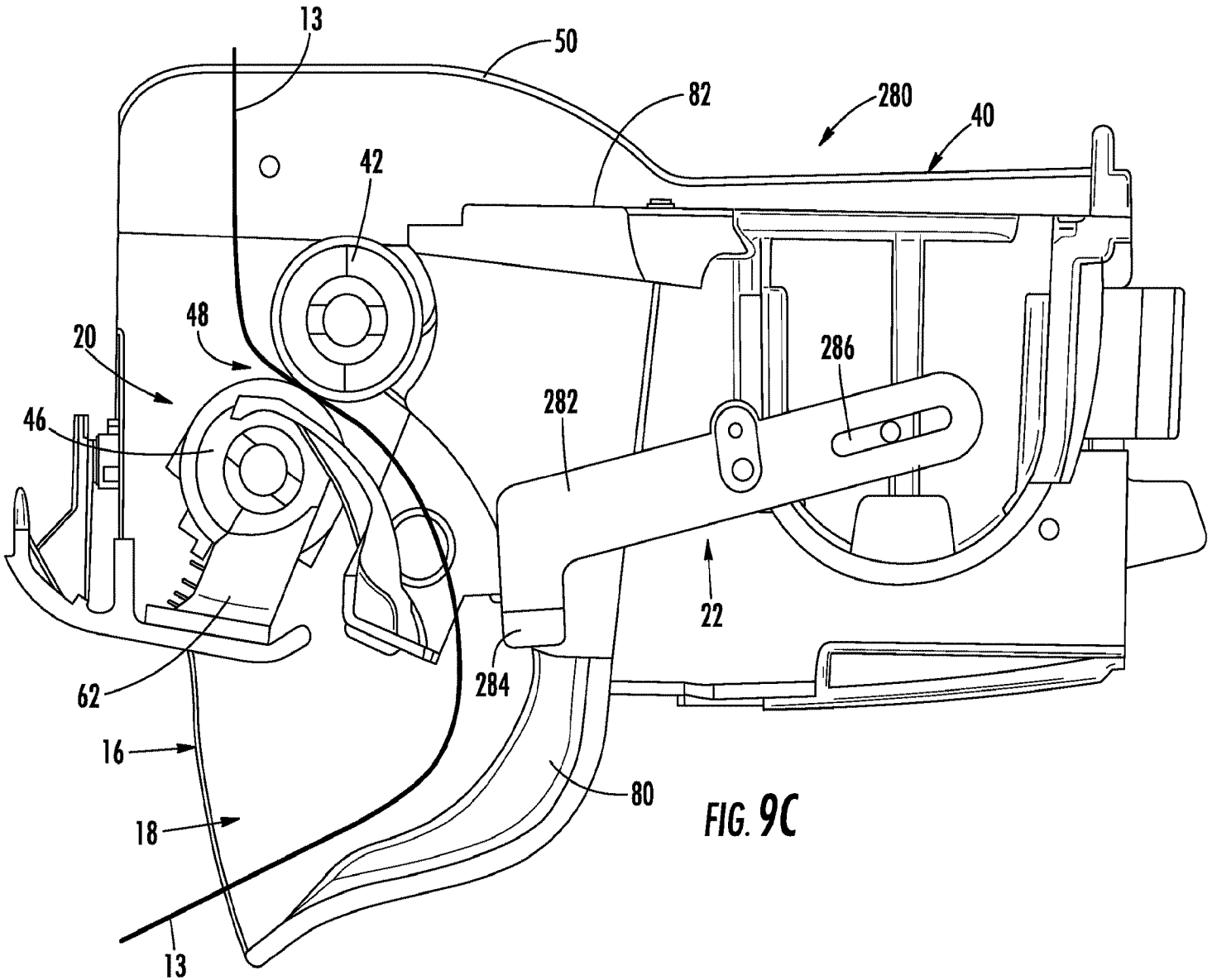

FIG. 9C is a partial side sectional view of the dispensing unit shown in FIG. 9A illustrating the pusher having reduced accumulation of sheet product in the dispenser chute.

Figure 9D:
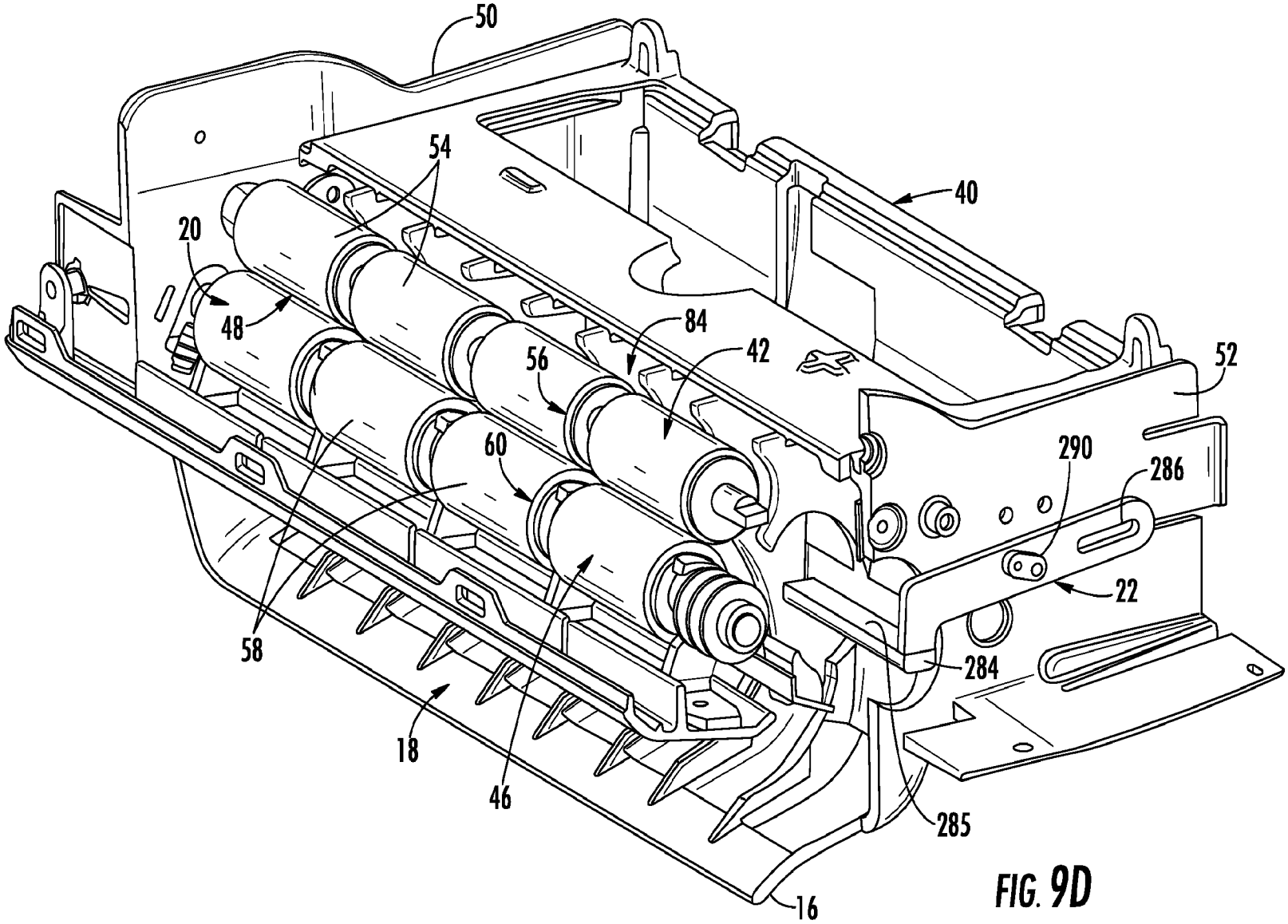

FIG. 9D is a partial side perspective view of the dispensing unit shown in FIG. 9A illustrating the pusher extending into the dispenser chute.

Figure 10:
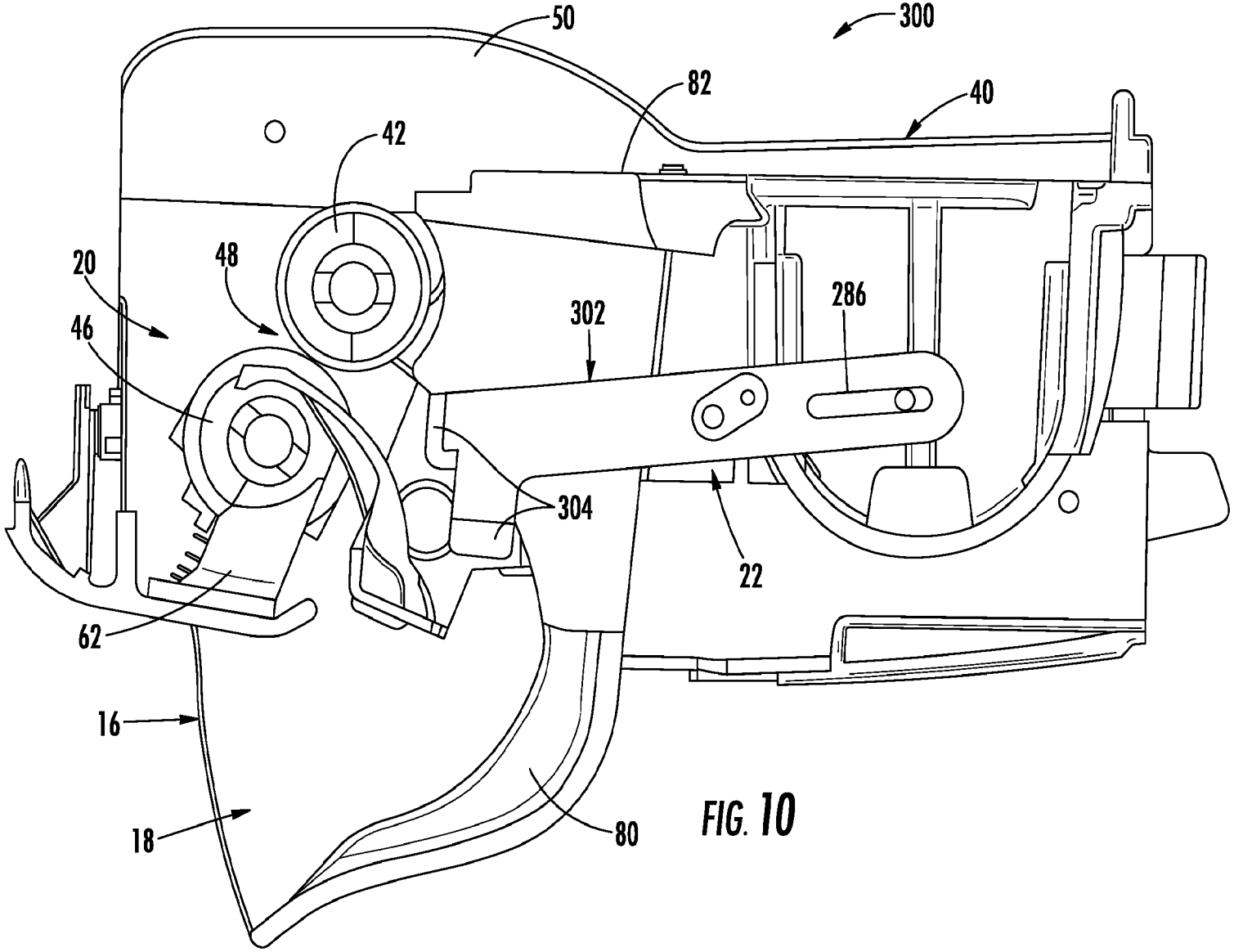

FIG. 10 is a partial sectional side view of a dispensing unit which forms part of the sheet product dispenser made in accordance with yet another embodiment of this disclosure.

Figure 11:
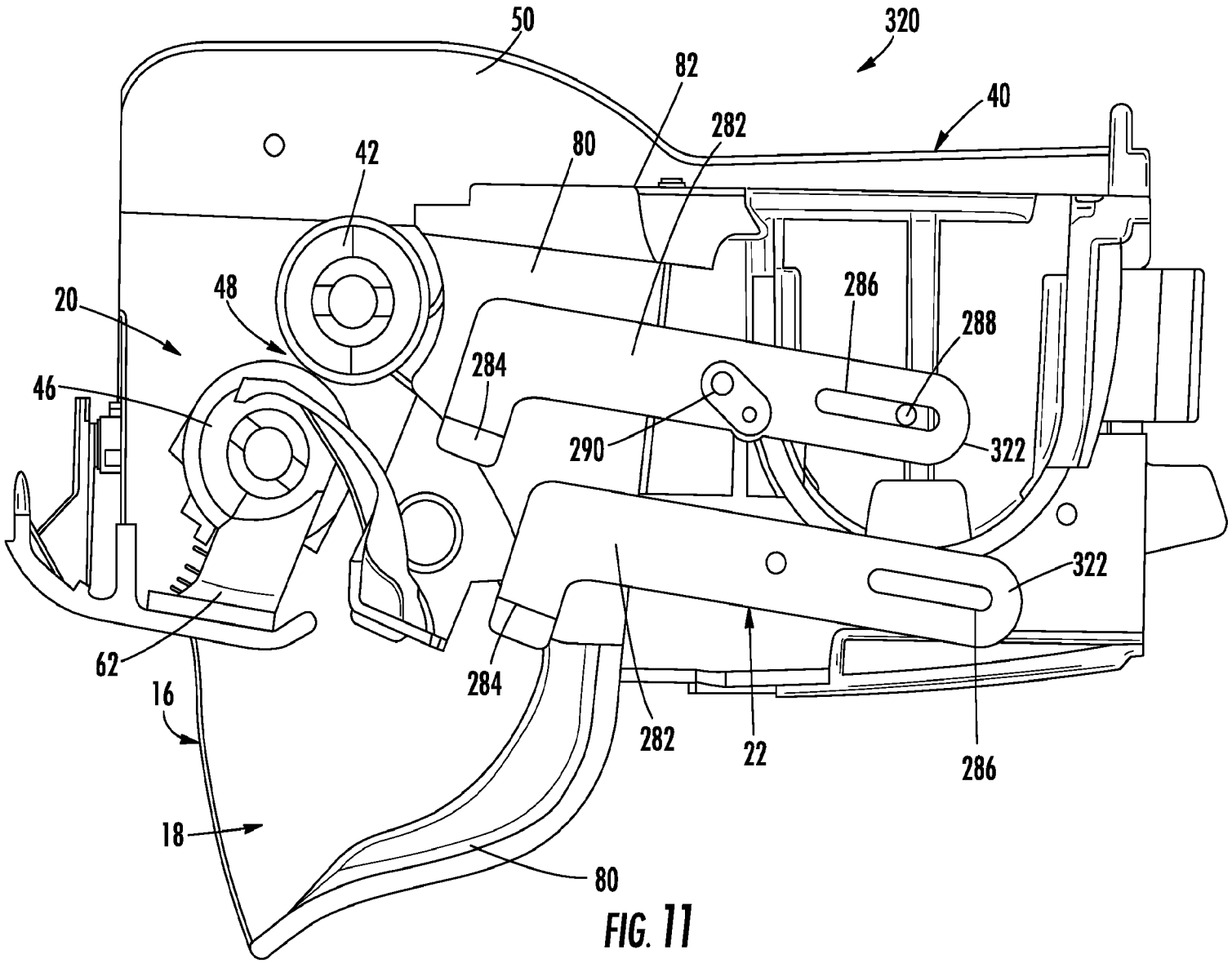

FIG. 11 is a partial side sectional view of a dispensing unit which forms part of a sheet product dispenser made in accordance with yet another embodiment of the disclosure.

Figure 12A:
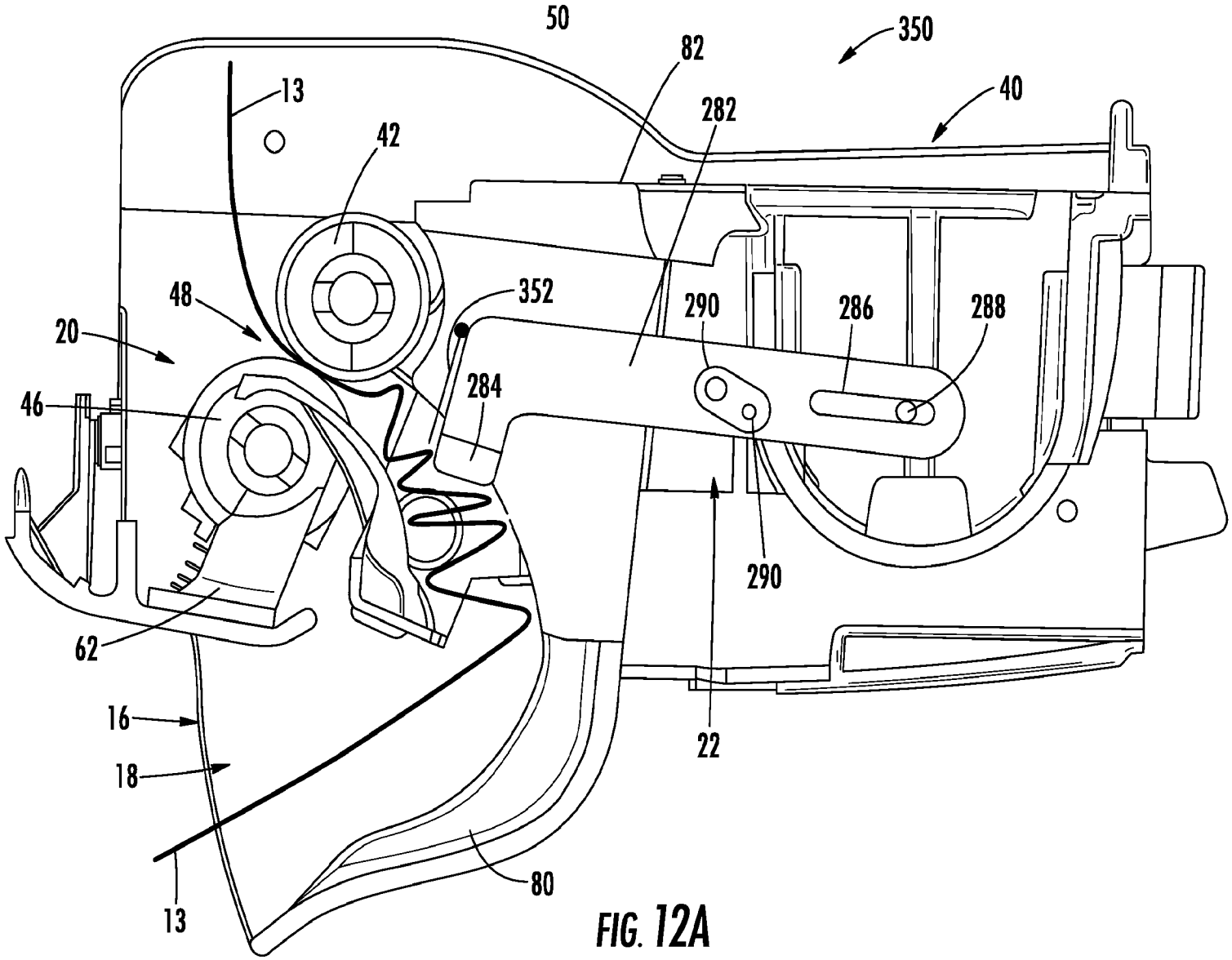

FIG. 12A is a partial sectional side view of a dispensing unit which forms part of a sheet product dispenser made in accordance with still another embodiment of the disclosure illustrating accumulation of sheet product fed from the feed roller assembly having accumulated in the dispenser chute.

Figure 12B:
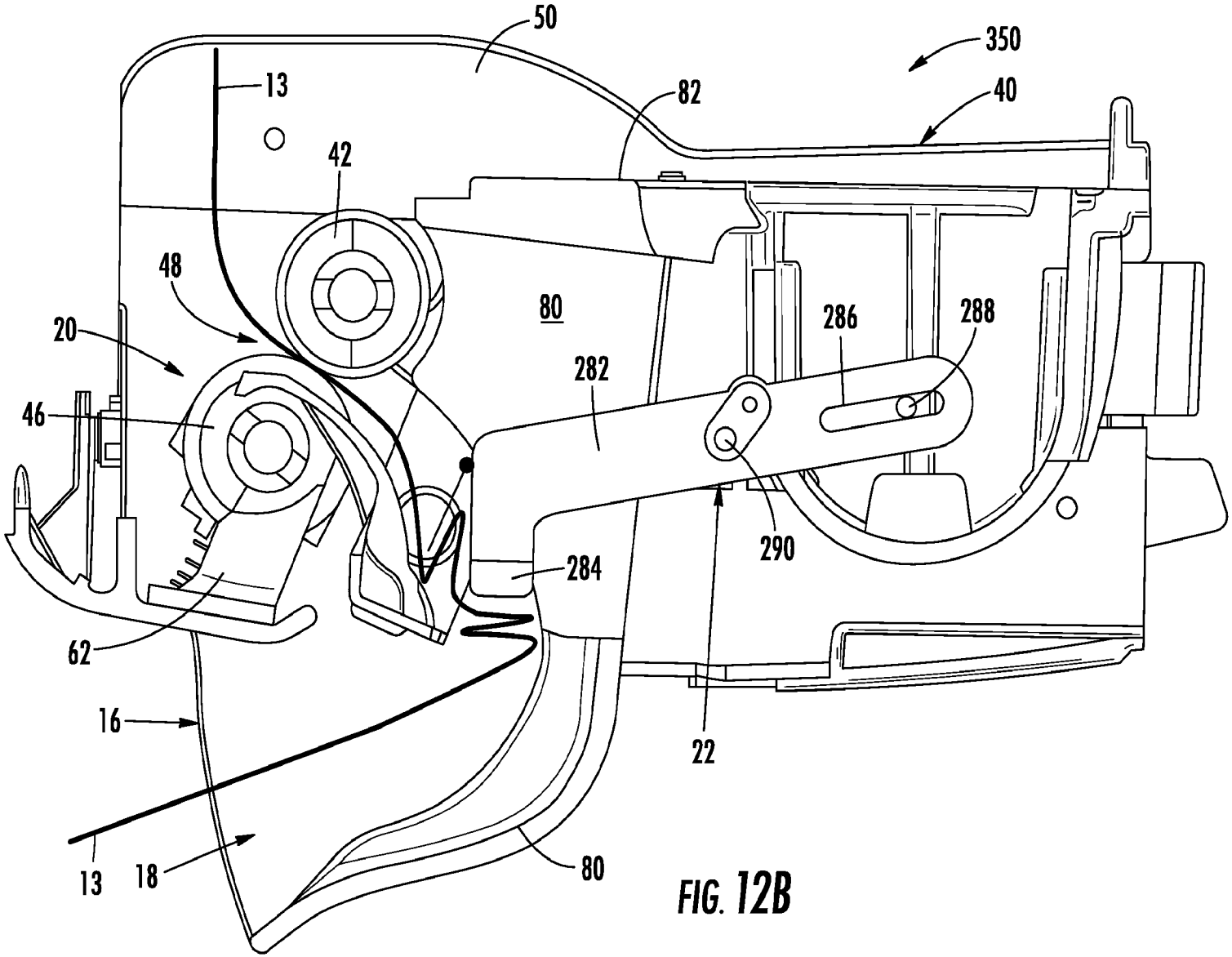

FIG. 12B is a partial side sectional view shown in FIG. 12A illustrating the pusher engaging the sheet product fed from the feed roller assembly.

Figure 12C:
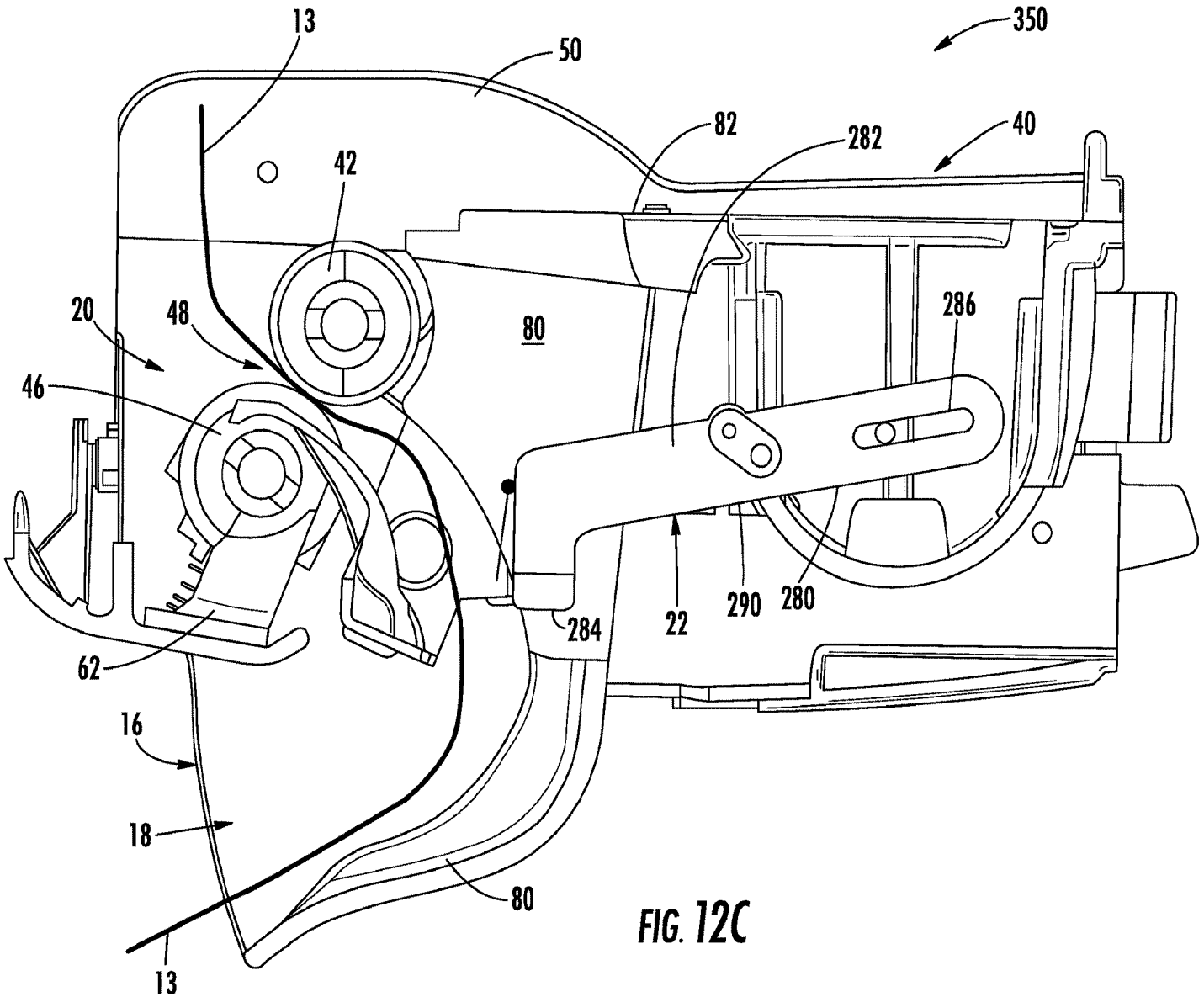

FIG. 12C is a partial side sectional view of the dispensing unit shown in FIG. 12A illustrating the pusher having reduced accumulation of a sheet product in the dispenser chute.

DETAILED DESCRIPTION

As summarized above, existing sheet product dispensers can suffer from sheet product accumulation in the dispenser chute which can cause jamming and other problems. The sheet product dispensers and related methods provided herein have been developed to address the foregoing and reduce the occurrences of bunching and potential jamming in sheet product dispensers and more consistently deliver sheet product to a user. Furthermore, embodiments of dispensers provided herein may also be more sanitary and hygienic by alleviating the need or temptation for the user to reach through the dispenser opening of a dispenser and into the chute to retrieve jammed sheet product.

The present disclosure includes non-limiting embodiments of sheet product dispensers and related methods for dispensing sheet product in a dispenser and reducing accumulation of sheet product in the chute of the dispenser. The embodiments are described in detail herein to enable one of ordinary skill in the art to practice the sheet product dispensers and related methods, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

Various embodiments of this disclosure are for purposes of illustration only. Parameters of different steps, components, and features of the embodiments are described separately, but may be combined consistently with this description of claims, to enable other embodiments as well to be understood by those skilled in the art. Various terms used herein are likewise defined in the description which follows.

As used herein, the term "sheet product" refers to a product that is relatively thin in comparison to its length and width and exhibits a relatively flat, planar configuration, yet is flexible or bendable to permit folding, rolling, stacking, or the like. As used herein, the term "sheet product" is inclusive of natural and/or synthetic materials. Example sheet products include towel, bath tissue, facial tissue, napkin, wipe, or other sheet-like products. Sheet products may be made from paper, cloth, woven, non-woven, metallic, polymer or other materials, and in some cases may include multiple layers or plies. In some embodiments, the sheet product may be continuous sheet that is severable or separable into individual sheets using, for example, a tear bar or cutting blade, while in other cases the sheet product may include predefined areas of weakness, such as lines of perforations, that extend along the width of the sheet product to define individual sheets and facilitate separation or tearing. As used herein, "continuous sheet" refers to a sheet product that is not individual unconnected precut sheets. In some embodiments, however, non-continuous sheet product may be used, such as, but not limited to an embodiment wherein the sheet product is a stack of interfolded individual sheets as is commonly found in some conventional dispensers.

There are a wide variety of non-woven processes for forming sheet products, which can be either wetlaid or drylaid. Examples of non-woven processes include, but are not limited to, hydroentangled (sometimes called "spunlace"), double re-creped (DRC), airlaid, spunbond, carded, papermaking, and melt-blown processes. Further, sheet products may contain fibrous cellulosic materials that may be derived from natural sources, such as wood pulp fibers, as well as other fibrous material characterized by having hydroxyl groups.

A continuous sheet product may be configured in different ways for use in a dispenser. For example, in some embodiments, the continuous sheet product may be a roll of continuous sheet product and in other embodiments may be pleated. As used herein, the term "roll of continuous sheet product" refers to a sheet product formed in a roll by winding layers of the sheet product around one another. Rolls of sheet product may be cored or coreless. As used herein, "pleated continuous sheet product" means a continuous sheet product folded into a stack along alternating fold lines.

The meanings of other terms used herein will be apparent to one of ordinary skill in the art or will become apparent to one of ordinary skill in the art upon review of the detailed description when taken in conjunction with the several drawings and the appended claims.

Figure 2:
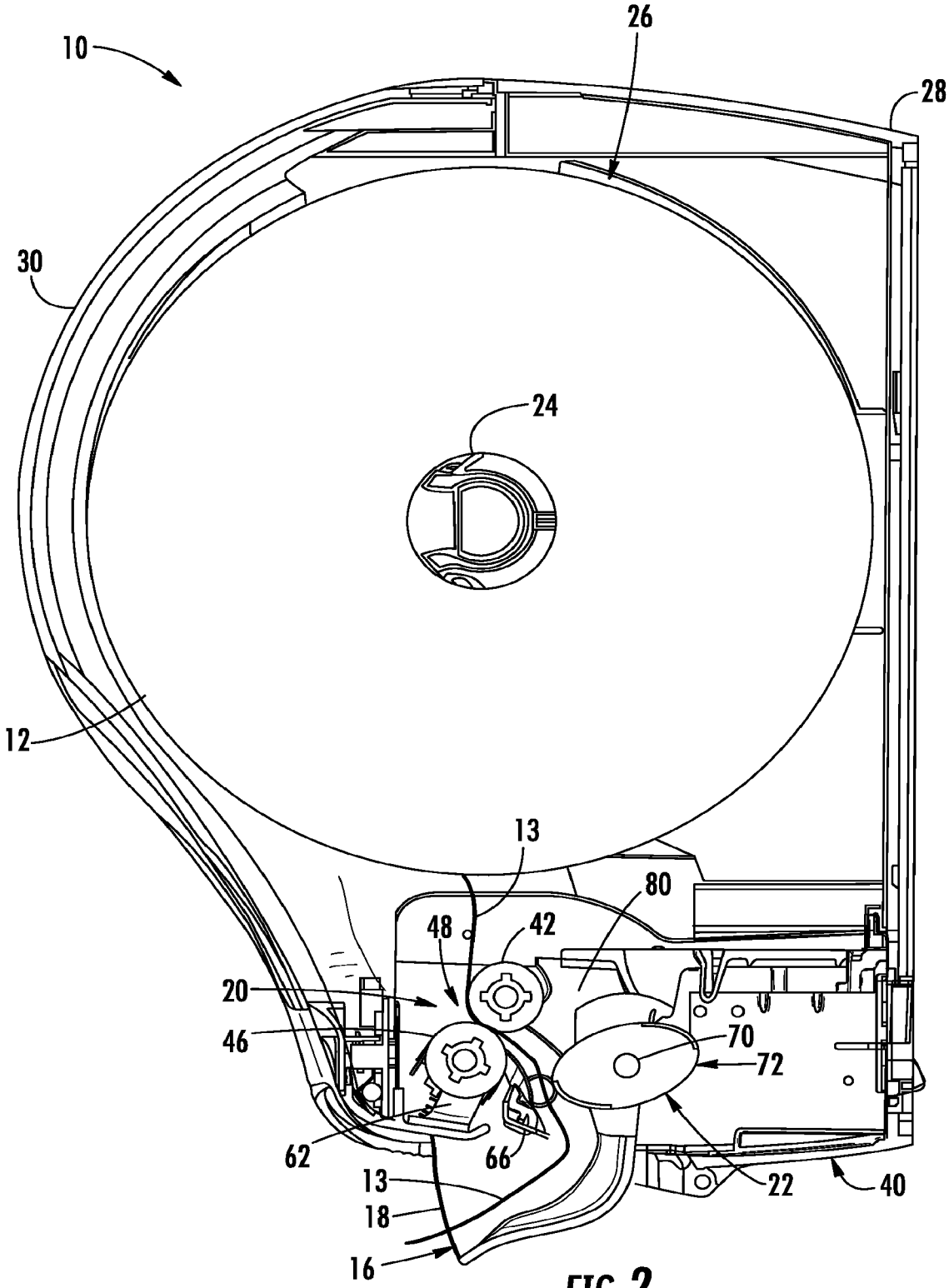
FIG. 2 is a side sectional view of the sheet product dispenser of FIG. 1 with a portion of the housing removed.

FIGS. 1-2 and 4-6D illustrate a sheet product dispenser 10 according to one or more embodiments of the disclosure. The dispenser 10 is configured to allow a user to obtain a length of sheet product from a sheet product supply, which in this embodiment is a roll 12 of continuous sheet product 13 supported by the dispenser 10 as shown in FIG. 2. As described in detail below, the dispenser 10 is configured to dispense sheet product 13 from the roll 12 with reduced accumulation of sheet product 13 within the dispenser 10. Although the embodiments illustrated in FIGS. 1-2 and 4-6D and other described embodiments illustrated in this disclosure employ a supply of sheet product in the form of a roll of continuous sheet product, it should be understood that still other embodiments within the scope of this disclosure may employ supplies of sheet product that are discontinuous, such as but not limited to a stack of interfolded individual sheets, and other configurations of continuous sheet product such as, but not limited to a pleated continuous sheet product. Although not illustrated or described in detail herein, embodiments of this invention may be adapted, as would be understood by those skilled in the art to employ a sheet supply mechanism such as that described in U.S. Pat. No. 8,998,055, the disclosure of which is incorporated herein in its entirety.

As shown in FIGS. 1 and 2, the dispenser 10 generally comprises a housing 14 comprising a chute 16 having a sheet product dispensing opening 18, a sheet product feed roller assembly 20 disposed in the housing 14 and configured to feed sheet product 13 into the chute 16, and a pusher 22 disposed in the housing and configured to engage the sheet product 13 fed from the sheet product feed roller assembly 20 at a location downstream from the sheet product feed roller assembly 20 and push the sheet product 13 fed from the sheet product feed roller assembly 20 toward the dispensing opening 18 to reduce accumulation of the sheet product 13 in the chute 16.

FIG. 2 illustrates the roll 12 of sheet product 13 according to one or more embodiments of the disclosure. The sheet product 13 may be paper towels, although other types of sheet product, such as bath tissue, facial tissue, wipers, or napkins may be used in the dispenser 10. The roll 12 of sheet product 13 may be formed in a conventional manner, whereby layers of the sheet product 13 are wound around one another. As shown, the roll 12 may have a length and an outer diameter defining a generally cylindrical overall shape and a circular cross-sectional shape. The roll 12 may include a central opening 24 extending therethrough along a longitudinal axis of the roll 12. The roll 12 may be a cored roll of sheet product 13, including a core of paperboard or other material defining the central opening 24 and around which the layers of sheet product 13 are wound. Alternatively, the roll 12 may be a coreless roll of sheet product 13, such that the central opening 24 is defined by an inner layer of the sheet product. In some embodiments, which may have a cored or coreless configuration, the roll 12 includes one or more removable shafts, plugs, or other members positioned within the central opening 24 for structural support during shipping or transportation, which may or may not be removed prior to loading the roll 12 in the dispenser 10.

In some embodiments, the sheet product 13 includes predefined areas of weakness, such as lines of perforations, extending across a width of the sheet product 13 between individual sheets thereof. In this manner, a user may separate one or more sheets from the roll 12 by tearing the sheet product 13 along one of the areas of weakness. In other embodiments, the sheet product 13 includes no predefined areas of weakness, such that the sheet product 13 is formed as a continuous sheet. In this manner, a user may separate a length of sheet product 13 from the roll 12 by tearing the sheet product at any desired location, as may be achieved by an abrupt pulling action and as may be facilitated by a tear bar of the dispenser 10, as described below.

As shown in FIGS. 1 and 2, the sheet product dispenser 10 may include the housing 14. During use of the dispenser 10, the roll 12 may be rotatably disposed completely within the housing 14 for dispensing sheet product therefrom. The housing 14 may include a plurality of walls and may define an interior space 26 inward of the walls and configured to receive the roll 12 therein. The interior space 26 may be substantially closed by the housing 14, although certain gaps or openings may be defined by the housing 14, as described below. The housing 14 includes the chute 16 which receives sheet product 13 from the feed roller assembly 20 and leads to the dispenser opening 18 defined in one or more of the walls and configured to allow the sheet product 13 to be dispensed therethrough. As shown, the dispenser opening 18 may be defined in a lower portion of the front wall of the housing 14, although other locations of the dispenser opening 18 may be used. During use of the dispenser 10, the sheet product 13 may be directed through the dispenser opening 18 and out of the housing 14, such that the sheet product 13 may be easily grasped by a user.

The housing 14 may include a base 28 configured to attach to a wall or other support surface for mounting the dispenser 10 thereto. For example, the back wall of the base 28 may be attached to a vertical wall, the bottom wall of the base 28 may be attached to a countertop surface, or the top wall of the base 28 may be attached to an under-counter surface. The housing 14 also may include a cover 30 movably connected to the base 28 and configured to move between a closed position for dispensing sheet product 13, as shown in FIG. 1, and an open position for placing the roll 12 of sheet product within the interior space 26. For example, the cover 30 may be pivotally connected to the base 28 via one or more pin connections or the like.

As shown in FIGS. 1-12C, the housing 14 also may include a dispenser chassis 40. In some embodiments, as shown, the dispenser chassis 40 includes the chute 16 which at least partially defines and leads to the dispenser opening 18. The dispenser chassis 40 also supports the feed roller assembly 20 which is mounted to the chassis. In some embodiments, the roll 12 of sheet product 13 is disposed atop the dispenser chassis 40. The foregoing embodiments are merely illustrative, as other configurations of the housing 14 and the dispenser chassis 40 of the dispenser 10 are possible.

As shown in FIGS. 2-12C the sheet product dispenser 10 includes the sheet product feed roller assembly 20 mounted to the dispenser chassis 40 and configured to dispense the sheet product 13 from the roll 12 into the chute 16 which leads to the dispenser opening 18. The feed roller assembly 20 may include a drive roller 42 and a pinch roller 46 defining a nip 48 there between for receiving and advancing the sheet product 13. The foregoing embodiments are merely illustrative, as other configurations of the feed roller assembly 20 are possible.

As best shown in FIGS. 6A-6D, the drive roller 42 is rotatably mounted to the dispenser chassis 40 and extends from one end 50 to another end 52 of the chassis 40, although in FIG. 6A only a portion of the drive roller 42 is shown. The drive roller 42 comprises a plurality of cylindrical segments 54 extending along a length of the drive roller 42 and separated by gaps 56. Likewise, the pinch roller 46 extends from the one end 50 of the dispenser chassis 40 through the other end 52 of the dispenser chassis 40 and is rotatably mounted thereto. The pinch roller 46 comprises a plurality of cylindrical segments 58 extending along a length of the pinch roller 46 with gaps 60 therebetween. Like the drive roller 42, the pinch roller 46 is only partially illustrated in FIG. 6A, but is fully shown in FIGS. 6B-6D. The gaps 56 of the drive roller 42 and the gaps 60 of the pinch roller 46 correspond and are adjacent to one another and the plurality of cylindrical segments 54 of the drive roller 42 and the plurality of cylindrical segments 58 of the pinch roller 46 correspond with and are adjacent to each other to form the nip 48 between the drive roller 42 and pinch roller 46. The drive roller 42 and pinch roller 46 are disposed in the dispenser chassis 40 adjacent to the chute 16 of the housing 14.

The sheet product dispenser 10 may further optionally comprise one or more stationary stripper members 62 fixed to the dispenser chassis 40 by being mounted to a mounting plate 64 affixed to and extending between the ends 50 and 52 of the dispenser chassis 40. The stripper members 62 extend from the mounting plate 64 into respective ones of the pinch roller gaps 60 between the pinch roller 46 and the drive roller 42 for guiding the sheet product 13 fed from the sheet product feed roller assembly 20 through the nip 48 between the drive roller 42 and the pinch roller 46 away from the sheet product feed roller assembly 20 and into the chute 16. Again, the foregoing embodiments are merely illustrative, as other configurations of the stripper members 62 are possible. Furthermore, the stripper members 62 are not necessary and may be omitted entirely.

As shown in FIGS. 2-5C, the dispenser 10 may also include a tear bar 66 positioned adjacent and downstream of the nip 48 between the drive roller 42 and the pinch roller 46. The tear bar 66 is offset towards the pinch roller 46 and extends between and is affixed to the ends 50 and 52 of the dispenser chassis 40. The tear bar 66 is configured for cutting the sheet product 13 fed from the sheet product feed roller assembly 20 downstream of the sheet product feed roller assembly 20 within the chute 16 of the housing 14. In an embodiment, the tear bar 66 is movable, such as pivotally movable. In an alternate embodiment, the tear bar 66 is stationary. The tear bar 66 may be formed as a plate having a sharp distal edge. Alternatively, the tear bar may form part of the housing 14. Furthermore, the tear bar 66 is disposed within and attached to the chassis 40 of the housing 14 and configured to cut the sheet product 13 to form a cut sheet product for removal from the sheet product chute 16. The dispenser 10 may be configured with different sheet product dispensing configurations having different user request settings know to those in the art. For example, the dispenser 10 may be configured to leave any remaining sheet product 13 fed from the sheet product feed roller assembly 20 within the chute. This provides for a more sanitary and hygienic operation of the dispenser 10 because no portion of the sheet product 13 remains extending out of the dispenser 10 through the dispenser opening 18 between dispensing cycles. Alternatively, however, the dispenser 10 could be configured for hang mode by mechanisms known to those skilled in the art to leave a portion of the sheet product hanging outside of the dispenser 10 through the dispenser opening 18, if desired. According to different embodiments, the dispenser 10 may be configured to dispense sheet product in response to a user hand waive sensor or by a switch triggered by the user grasping the sheet product and pulling it against the tear bar 66 to cut the sheet product or by direct manual activation of a switch by a user. The dispenser 10 may be configured for different dispensing modes which may be selected by the user or installer. The foregoing embodiments are merely illustrative, and other configurations of the tear bar 66 and sheet dispensing are possible.

In some embodiments, the pusher 22 is rotatably mounted to and extends between the opposing ends 50 and 52 of the dispenser chassis 40 within the chute 16 proximate to and downstream of the nip 48 between the drive roller 42 and pinch roller 46 of the feed roller assembly 20. The pusher 22 is configured to engage any accumulated portion of the sheet product 13 fed from the sheet product feed roller assembly 20. In some embodiments, the pusher 22 is configured to repeatedly move into and out of position for engagement with an accumulated portion of the sheet product 13 fed from the sheet product feed roller assembly 20 or selectively move into and, alternatively or additionally, move out of position for engagement with an accumulated portion of the sheet product 13 fed from the sheet product feed roller assembly 20. When a portion of the sheet product 13 accumulates in the chute 16, the pusher 22 engages the portion of the sheet product 13 accumulated in the chute 16 and pushes the accumulated portion toward the dispenser opening 18. Alternatively, according to another embodiment described herein below, the pusher 22 is configured to substantially continuously engage a portion of the sheet product 13 accumulated in the chute 16 from the sheet product 13 fed from the sheet product feed roller assembly 20. In the embodiments illustrated in FIGS. 1, 2 and 4-6F the pusher 22 is configured to oscillate between a remote position, such as illustrated in FIGS. 5A and 5C, in which the pusher 22 is remote from the sheet product 13 fed from the sheet product feed roller assembly 20, and an engagement position, illustrated in FIG. 5B, in which the pusher 22 can engage a portion of the sheet product 13 accumulated from the sheet product 13 fed from the sheet product feed roller assembly 20. When sheet product accumulates in the chute 16, the pusher 22 does engage the sheet product 13 in the engagement position.

In the embodiments illustrated FIGS. 1, 2, and 4-6F the pusher 22 comprises a rotatable pusher roller 70. The rotatable pusher roller 70 may comprise one or more pusher members 72 configured to engage the sheet product 13 fed from the sheet product feed roller assembly 20. The pusher members 72 may be any suitable shape, including but not limited to cylindrical, non-cylindrical, elliptical, triangular, rectangular, paddle-shaped, star-shaped, diamond-shaped, oval, or the like. In the embodiment shown in FIGS. 1, 2, and 4-6F, the pusher members 72 are oval and the pusher 22 comprises a plurality of the one or more pusher members 72 extending along a length of the rotatable pusher roller and spaced from one another. In this embodiment the plurality of pusher members 72 are aligned with one another. Alternatively, however, as will be explained with regard to another embodiment, the pusher members 72 may be offset from one another on the rotatable pusher roller.

In the embodiments illustrated in FIGS. 1, 2, and 4-6F, the elliptical or oval pusher members 72 each comprise two opposing tips 73, each opposing tip 73 comprising at least one high friction area 74 configured to engage a portion of the sheet product 13 accumulated from the sheet product 13 fed from the sheet product feed roller assembly 20 as the pusher roller 70 rotates. High friction area means that the area has a coefficient of friction sufficiently high to create enough friction between the pusher members 72 and the sheet product 13 upon engagement of the sheet product 13 push the sheet product at least partially through the chute 16. Suitable material for the high friction area 74 includes, but is not limited to polymeric material such as rubber.

Thus, each of the plurality of pusher members 72 are configured to oscillate between a remote position in which the pusher members are remote from the sheet product 13 fed from the sheet product feed roller assembly 20 and an engagement position in which the pusher members 72 can engage a portion of the sheet product 13 accumulated from the sheet product 13 fed from the sheet product feed roller assembly 20. In some embodiments, the pusher members 72 are configured to selectively move into and, alternatively or additionally, move out of position for engagement with a portion of the sheet product 13 accumulated from the sheet product 13 fed from the sheet product feed roller assembly 20.

In FIG. 6A, a portion of the dispenser 10 is cut away to enable a view of dispenser components. The chute 16 may comprise one or more stationary chute members 80 for guiding the sheet product 13 fed from the sheet product feed roller assembly 20 away from the sheet product feed roller assembly and toward the dispensing opening 18. The embodiment illustrated in FIGS. 6A-6F comprises a plurality of the one or more stationary chute members 80 which extend from a top 82 of the dispenser chassis 40, adjacent the drive roller 42, and along the chute 16 to proximate the dispensing opening 18. The chute members 80, or ribs, are spaced from one another between the opposing ends 50 and 52 of the dispenser chassis 40 to form a series of chute channels 84 in which respective ones of the pusher members 72 are at least partially disposed. Thus, in this embodiment, there is an oval or elliptical pusher member 72 in each space or chute channel 84 between the chute members or ribs 80.

As shown in FIGS. 6A-6F, the dispenser 10 may further comprise a motor 90 (only partially shown in FIGS. 6A, 6D, and 6E) in operable communication with the drive roller 42 for selectively driving the drive roller 42. The motor 90 may be in communication with the drive roller 42 directly or via a coupling 91 between the motor 90 and the drive roller 42 which transfers motion to the pusher 22 through one or more cooperating gears 92. Alternatively, the motor 90 may also be in operable communication with the rotatable pusher roller 70 to drive the pusher roller 70. Thus, according to some embodiments, the drive roller 42, and therefore the feed roller assembly 20, and the pusher 22, and therefore the rotatable pusher roller 70 and associated pusher members 72, may be synchronized in operation. In some embodiments, the pusher 22 may be operated at a different speed than the drive roller, and therefore the feed roller assembly 20. For example, in some embodiments, the pusher 22 may be operated at a faster speed than the drive roller 42. Furthermore, in some embodiments, the speed of the pusher 22 may be faster, slower, equal, or variable compared to the speed of the surface of the drive roller 42.

Any type of motor 90 can be used to drive the feed roller assembly 20 or the pusher 22, or both. Suitable motors include, but are not limited to, electric brushed motors, electric brushless motors, electric stepper motors, or electric solenoid motors. Alternatively to a system in which a motor provides a driving force to operate the feed roller assembly 20 or the pusher 22, or both, the feed roller assembly 20 or the pusher 22 or both may be operable by a user driven mechanism, such as a hand crank or a hand lever or by user pulling the sheet product, or any system in which a user provides the driving force to operate the feed roller assembly 20 or the pusher 22, or both.

The motor 90 also may be in operable communication with a controller (not shown) of the dispenser 10, which may be configured to selectively activate the motor 90. In some embodiments, the controller is in operable communication with an input device configured to be directly manually activated. The input device may be button, switch or other type of device, or the like, configured to be directly manually activated. The controller may also be in operable communication with a proximity sensor 96 configured to detect the presence of a user's hand proximate to the dispenser 10 or may be activated by the user grasping and pulling the sheet product.

Dispensing of a length of the sheet product 13 from the sheet product roll 12 for an end user may be carried out in a conventional manner. Specifically, in response to placement of a user's hand proximate to the dispenser 10 as detected by the user proximity sensor 96, the controller may activate the motor 90, thereby driving the drive roller 42 and the rotatable pusher roller 70 and advancing a length of the sheet product 13 through the nip 48 between the drive roller 42 and the pinch roller 46 and into the chute 16. If the dispensed sheet product 13 accumulates in the chute 16, the opposing tips 73 of the pusher member 72 engage the dispensed sheet product 13 in the chute 16 and push the sheet product through the chute 16 and out the dispensing opening 18 to reduce or prevent accumulation of the sheet product 13 in the chute 16.

Figure 3:
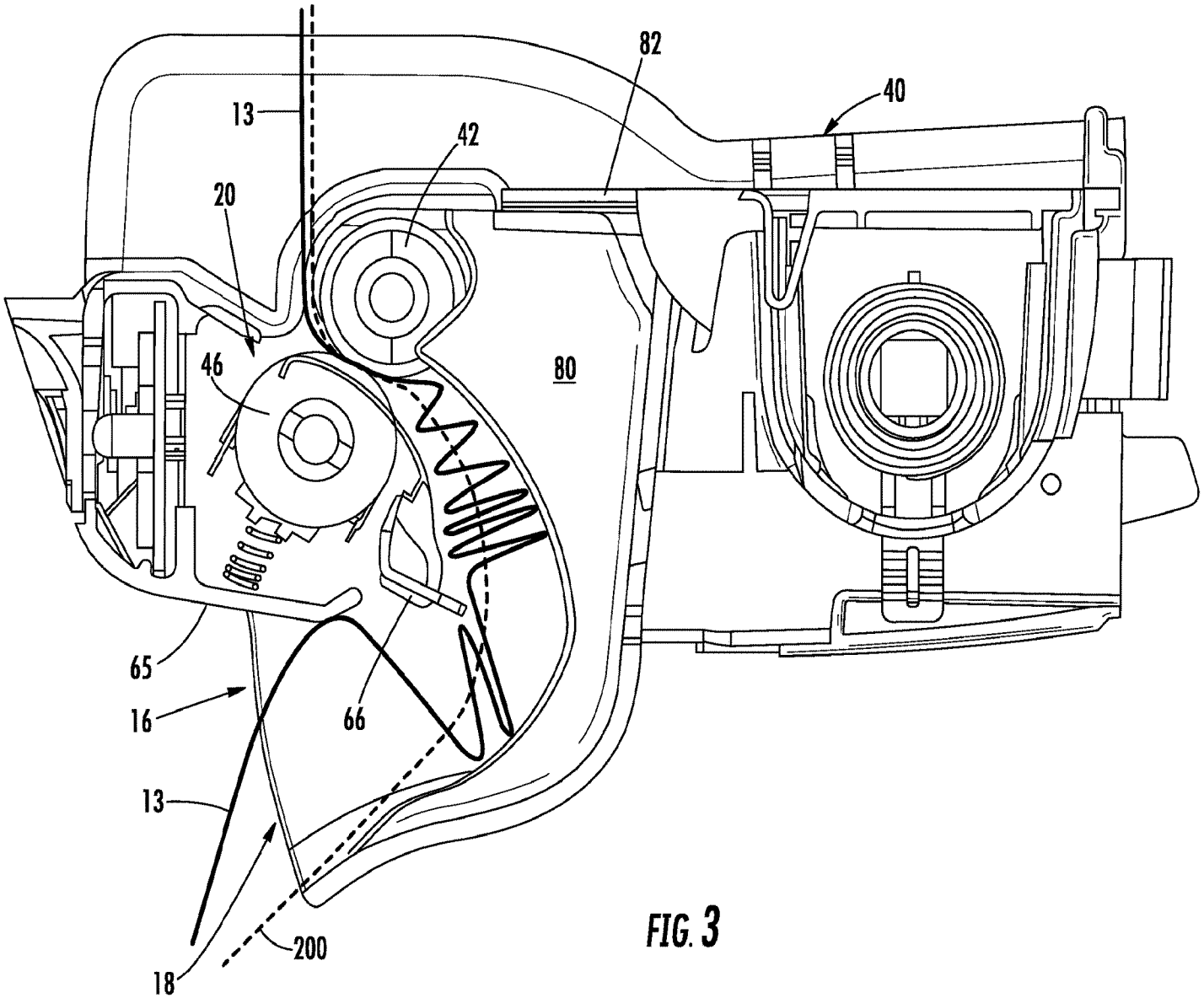
FIG. 3 is a partial sectional view of a dispensing unit which is a component of the sheet product dispenser of FIG.

FIG. 3 does not include the pusher 22 in the illustration so as to show what happens when a portion of sheet product 13 fed by the feed roller assembly 20 into the chute 16 of a dispenser 10 that is not equipped with the pusher 22 accumulates in the chute 16. The dash line 200 in FIG. 3 shows the expected path that the sheet product 13 travels through the dispenser 10. The sheet product 13 comes off the sheet product roll 12 and passes between the drive roller 42 and the pinch roller 46 through the nip 48 therebetween, passes through the chute 16 and continues past the tear bar 66, and continues down the chute 16 until leaving the dispenser 10 through the dispensing opening 18.

Turning to FIG. 4, as the feed roller assembly 20 feeds sheet product 13 through the nip 48 between the drive roller 42 and the pinch roller 46, the stripper members 62 barricade and close off space between the pinch roller 46 and the top 65 of the chute 16, thereby preventing the sheet product from wrapping around the pinch roller 46 and causing a jam. Similarly, the stationary chute members 80 barricade and close off space between the drive roller 42 and the top 82 of the dispenser chassis 40, thereby preventing the sheet product from wrapping around the drive roller 42 and causing a jam. Once the dispenser 10 has dispensed an amount of sheet product 13, a user can tear that amount of sheet product 13 against the tear bar 66, leaving the dispenser 10 ready to dispense a next amount of sheet product 13 which remains inside the chute 16 until the next dispense cycle.

However, as illustrated in FIG. 3, the sheet product 13 dispensed into the chute 16 by the feed roller assembly 20, due to flexibility of the sheet product 13, may buckle, bunch, and jam and accumulate in the chute 16 if a leading edge or any other portion of the sheet product 13 experiences sufficient resistance downstream of the feed roller assembly nip 48. If the resistance is stronger than the strength of the sheet product 13, the sheet product may buckle, movement of the leading edge of the sheet product 13 may stop, while the feed roller assembly 20 continues to advance a trailing edge of the sheet product 13, thus causing a portion of the sheet product to accumulate, or bunch between the leading edge of the sheet product 13 and the nip 48 between the drive roller 42 and the pinch roller 46. The dispenser 10 illustrated in FIGS. 1-2 and 4-6C, however, is able to reduce such bunching and jamming and consistently deliver the sheet product 13 to a user. FIG. 5B shows the pusher members 72 pushing the sheet product 13 out of the chute 16 instead of letting the sheet product bunch or jam inside the chute 16. In FIG. 5B, the oval pusher members 72 have advanced far enough to engage the bunched sheet product 13 and push the bunched sheet product out of the chute 16. In FIG. 5C, sufficient rotation of the pusher member 72 has removed the bunched sheet product and made the sheet product 13 available to a user and prevented a jam.

In the embodiment shown in FIGS. 1-2 and 4-6F, the tips 73 of the oval pusher members 72 may travel faster than the drive roller 42 delivers sheet product to the chute 16. In this manner, the oval pusher members 72 are able to clear the sheet product out of chute 16 faster than drive roller 42 introduces sheet product that might otherwise exacerbate accumulation and bunching. However, it should be appreciated that the pusher member 72 may travel slower than or at the same rate as the drive roller 42 introduces new sheet product 13, yet the pusher members 72 may still be effective at clearing the bunched accumulation. For example, the pusher members 72 may push several folds of bunched sheet product 13 out of the chute 16 in a single motion removing a great deal more sheet product length from the chute 16 than the drive roller 42 has introduced. In addition, the sheet product may have its own tendency to straighten itself. As such, the pusher 72 may only need to push one fold of bunched sheet product 13 out of the chute 16, after which the remaining sheet product in the chute 16 may quickly expand out of the chute 16 in the same manner that a compressed spring expands once released. In this manner, it is also possible for the pusher member 72 to move slower than or at the same rate as the drive roller 42 introduces sheet product 13 to the chute, yet still be able to clear the sheet product 13 that is bunched. The drive roller 42 and pusher roller 70 may be operated at different speeds by mechanisms such as cooperating gear or belt arrangements operated synchronously or by independent motors or by other mechanisms known to those skilled in the art.

A sheet product dispenser 210 made in accordance with another embodiment of this disclosure is illustrated in FIG. 6E and comprises oval pusher members 72 disposed only in alternating chute channels 84 of the chute chassis 40, thus illustrating that in some embodiments, it is possible for fewer chute pusher members 72 to adequately clear any bunching and prevent sheet product jams in the chute 16. In this embodiment, the pusher members 72 are aligned, although this is not necessary.

FIG. 6F illustrates a sheet product dispenser 220 made in accordance with another embodiment of this disclosure. This sheet product dispenser 220 comprises a plurality of pusher members 72 aligned axially along the pusher roller 70, but staggered or offset radially from one another such that the orientation of the tips 73 of the pusher members 72 relative to each other is about 90 degrees apart. Alternatively, the pusher members 72 could be radially offset to a different extent. In this embodiment, there is a pusher member 72 in each of the chute channels 84, however, this may not be necessary in some embodiments.

In the embodiment shown FIGS. 6A-F, the pusher members 72 are disposed in the chute channels 84 between the chute members 80; however, in alternative embodiments, such chute members 80 may not be necessary.

FIGS. 7A and 7B illustrate a sheet product dispenser 230 comprising an alternative pusher 22 comprising one or more cylindrical pusher members 232 rotatably disposed along a rotatable pusher roller or rod 234 extending between and mounted to opposing ends 50 and 52 of the dispenser chassis 40 in at least a lower portion of the chute 16 downstream of the nip 48 between the drive roller 42 and the pinch roller 46. In some embodiments, the dispenser 230 illustrated in FIGS. 7A and 7B comprises a plurality of such one or more cylindrical pusher members 232 spaced from one another. The cylindrical pusher members 232 may be positioned below the feed roller assembly 20 as illustrated in FIGS. 7A and 7B. The cylindrical pusher members 232 can be in different positions within the chute 16, however, the cylindrical pusher members 232 are configured to make substantially continuous engagement with a portion of the sheet product 13 accumulated from sheet product 13 dispensed by the feed roller assembly 20, at least until a sheet product 13 has been dispensed from the chute 16.

The chute product dispenser 230 and FIGS. 7A and 7B may comprise one or more gears 236 operably associated with the one or more cylindrical pusher members 232, such as through the rotatable pusher roller 234, and a drive belt 238. Optionally, this dispenser 230 may comprise a tensioning pulley 240 for maintaining tension in the drive belt 238. In this embodiment, the cylindrical pusher members 232 may have a low friction surface. In an alternative embodiment, a cylindrical pusher member 232 may have a high-friction surface. The chute product dispenser 230 illustrated in FIGS. 7A and 7B may be driven and operated in the same manner as the embodiments described hereinbefore. Although, toothed pulleys are depicted in this embodiment, any suitable pulley or drive belt with or without teeth or any other mechanism for transferring rotation may be used, such as but not limited to a gear system. Also, depending on the particular embodiment, the cylindrical pusher members 232 may or may not be disposed in spaces between chute members 80.

FIG. 7B depicts sheet product bunching in the chute 16, however, the cylindrical pusher members 232 removes such bunched or accumulated sheet product from the chute 16 as the pusher members 232 rotate until the sheet product 13 exits the chute 16.

FIG. 8 shows a sheet product dispenser 250 made in accordance with an alternative embodiment of this disclosure. In this sheet product dispenser 250, the pusher 22 comprises one or more conveyors 252, and in some embodiments, a plurality of said one or more conveyors 252. The one or more conveyors 252 each comprises a driven conveyor roller 254, an idle roller 256, and a conveyor belt 258 configured to travel around the driven conveyor roller 254 and idle roller 256 and engage a portion of the sheet product 13 accumulated from the sheet product 13 fed from the sheet product feed roller assembly 20. Some embodiments may comprise a plurality of the conveyors 252 rotatably mounted to respective rods or rollers 260 which are rotatable and extend between the opposing ends 50 and 52 of the dispenser chassis 40 spaced from one another. In FIG. 8, the conveyor belt 258 travels in a counter-clockwise motion to engage a portion of the sheet product 13 accumulated from sheet product 13 fed by the feed roller assembly 20 into the chute 16 to remove sheet product bunching and prevent sheet product jams. The conveyors 250 are disposed in the chute 16 downstream of the nip 48 between the drive roller 42 and the pinch roller 46, such that the traveling conveyor belt 258 travels in a direction to engage and push the sheet product 13 in the chute 16 through the chute and toward the dispensing opening 18. The manner of operation of the chute product dispenser 250 shown in FIG. 8 is otherwise the same as with the embodiments described hereinabove.

FIGS. 9A-9D show an embodiment of a sheet product dispenser 280 made in accordance with another embodiment of this disclosure. This sheet product dispenser 280 comprises one or more alternative pusher members 282. In some embodiments, the sheet product dispenser 280 may comprise a plurality of such one or more pusher members 282. Each of the one or more pusher members 282 comprises a tip 284 and a crank arm 290 configured such that the one or more pusher members 282 can move into and out of engagement with any of the sheet product 13 accumulated in the chute 16 to push the sheet product through the chute and toward the dispensing opening 18. The pusher members may be configured so that the tip 284 follows a path prescribed by a motion-generator. The pusher members 282 can be configured in different ways to perform this motion-generator function, including but not limited to various rotary to linear motion converters such as a slot and pin arrangement illustrated in FIGS. 9A-9D, other slider crank mechanisms, a cam, a rocker arm, a trip hammer, a scotch and yoke, a swash plate, a wobble plate, a ball screw, and the like. As a result the path of the tip 284 prescribed by the motion-generator may have different shapes, including circular and non-circular.

In the embodiment in FIGS. 9A-9D, each of the one or more pusher members 282 comprises a tip 284 and a slot 286 distal from the tip and the dispenser 280 further comprises one or more stationary pins 288 and one or more crank arms 290, the one or more pusher members 282 configured with the one or more stationary pins 288 and the one or more crank arms 290 such that, when the one or more crank arms 290 are rotated, the one or more stationary pins 288 guide each of the one or more pusher members 282 in oscillation between a remote position, in which one or more pusher members 282 are remote from the sheet product 13 fed from a sheet product feed roller assembly 20, and an engagement position, in which the tip or tips 284 of the one or more pusher members 282 can engage a portion of the sheet product 13 accumulated from the sheet product 13 fed from the sheet product feed roller assembly 20. In some embodiments the tips 284 may comprise a high friction area such as described in occurrence with other embodiments.

As illustrated in FIG. 9D, the tip 284 of the arm 290 may have an extension such as a foot 285 that extends from the tip 284 into the chute 16 along at least a portion of the feed roller assembly 20 for engaging any of the sheet product 13 accumulated in the chute 16 to push the sheet product through the chute and toward the dispensing opening 18. The extension or foot 285 allows placement of a motion-generator for moving the arm 290 and its tip 284 at a location in the dispenser 280 remote from where the tip 284 engages the sheet product 13 thereby enabling more efficient use of space in the dispenser or more flexibility or optionality in dispenser design or a combination thereof. In the embodiment illustrated in FIG. 9D, the motion-generator includes at least the crank arms 290, the slots 286, the stationary pins 288 and the motor that drives them, however, this embodiment is only exemplary and other motion generator mechanisms, including others that can be remotely located and enable more efficient use of space in the dispenser or more flexibility or optionality in dispenser design, or a combination thereof, are possible as would be understood by those skilled in the art.

In some embodiments, the sheet product dispenser 280 illustrated in FIGS. 9A-9D moves in an oscillating path of motion prescribed by the motion-generator which may be linear, curved, circular, or a combination of those. The speed of motion of the tips 284 may be faster, slower, equal, or variable compared to the speed of the surface of the drive roller 42. A plurality of the pusher members 282 may extend adjacent the feed roller assembly 20 and space from one another between the opposing ends 50 and 52 of the dispenser chassis 40.

The crank arms 290 may be driven by a motor or a manual actuator and may be synchronized with the drive roller or operated separately from the drive roller. The pusher members 282 may actuate the same time as the drive roller 42 or in a different time than the drive roller 42. The crank arms 290 are connected to the pusher members 282 and, as part of the motion-generator, produce a path of motion at the tips 284 of the pusher members 282. The pusher members 282 glide along the stationary pins 288 which extend through the slots 286 as the crank arms 290 are rotated. This motion brings the tips 284 of the pusher members 282 into and out of engagement with sheet product accumulated in the chute 16 to push the sheet product through the chute and toward the dispensing opening 18.

The tips 284 of the pusher members 282 may be in a suitable shape and may be made of any material with suitable properties such as the sufficient amount of friction to push the sheet product 13 through the chute 16. In some embodiments, the tips 284 comprise a relatively high friction material, such as rubber. Accordingly, some embodiments, the pusher members 282 may be disposed within the chute channels 84 between the chute members 80. According to other embodiments, the pusher members 282 may be disposed in all of the chute channels 84. In some embodiments, the tips 284 of the pusher members 282 may be aligned and, in other embodiments, the tips 284 of the pusher members 282 may be offset from one another.

FIG. 9A shows a pusher member 282 out of engagement with sheet product 13 accumulated in the chute 16. FIG. 9B shows the oscillating chute pusher 282 at a later time in the dispense cycle than in FIG. 9A and the crank arm 290 has rotated counter-clockwise and thereby advanced the tip 284 of the chute pusher member 282 along the path of motion in which the tip 284 has engaged an accumulated portion of sheet product in the chute 16 and pushed the sheet product 13 closer to the dispensing opening 18. FIG. 9C shows the pusher member 282 after the pusher member has removed the bunched sheet product 13 out of the chute 16. The tip 284 of the pusher member 282 has descended to a point that it has moved the sheet product 13 to a more downstream location at which point the sheet product 13 naturally expands out of the chute 16 and, at which point, the sheet product is also more revealed to a user to retrieve the sheet product from the dispenser 280.

The oscillating pusher members 282 shown in FIGS. 9A-9D have a path of motion that is somewhat ovular; however, any suitable path of motion may be used that is effective to push bunched or accumulated sheet product material 13 from the chute 16. In addition, any suitable motion-generator may be used to generate the path of motion for the tip 284 and any suitable material may be used for the tip to do the same.

FIG. 10 illustrates a sheet product dispenser 300 in accordance with another embodiment of this disclosure which is the same as the embodiment 280 illustrated in FIGS. 9A-9D, except that the sheet product dispenser 300 comprises pusher members 302 comprising a plurality of tips 304 configured to engage a portion of the sheet product 13 accumulated from the sheet product 13 fed from the sheet product feed roller assembly 20 as the one or more pusher members 302 rotate. The multiple tips 304 of the pusher members 302 increase the range of the chute 16 that may be reached by the pusher members 302, and therefore the range of the chute 16 that may be cleared of sheet product bunching, to increase reliability at clearing bunching and preventing sheet product jams.

FIG. 11 depicts a sheet product dispenser 320 which is the same as the sheet product dispenser 280 illustrated in FIGS. 9A and 9C except that two or a plurality of pusher members 322 are disposed in respective chute channels 84 between the chute members 80. Other embodiments may include more than two pusher members 322 in the chute channels 84. In some embodiments the multiple pusher members 322 may allow each pusher member to have a unique path of motion rather than a single path of motion for a single chute pusher member. Furthermore, a unique path of motion may enable more ability to remove bunched sheet product and sheet product jams, an increased amount of the chute 16 that the pusher members 322 can reach to remove bunched sheet product and sheet product jams, and more ability to fit within space constraints.

Although the multiple pusher members 322 illustrated in FIG. 11 are depicted as the translating or oscillating types of pusher member 322, other embodiments described hereinabove may be adapted to include any combination of rotating, conveyor belt, translating, oscillating, or other types of pusher members within any of the chute channels 84 between the chute members 80. Furthermore, different embodiments of this disclosure may include different combinations of rotating, conveyor belt, translating, oscillating, or other types of pusher members within any appropriate location of the respective dispenser, without any relationship to chute members 80. Furthermore, different embodiments may include one or more pusher members at any or all locations between the nip 48 of the driver 42 and pinch roller 46 and the dispensing opening 18 of the chute 16. More specifically, different embodiments may include one or more pusher members at any location in the sheet product path between the drive roller nip 48 and the dispensing opening 18 of the chute 16.

It should also be appreciated that the tips of all pusher members may be further mechanically enhanced. FIGS. 12A-12C depict a sheet product dispenser 350 in accordance with another embodiment of the disclosure. This sheet product dispenser 350 is the same as the sheet product dispenser 280 illustrated in FIGS. 9A-9D except that the tips 284 of the pusher members 282 comprise a pawl 352 pivotally mounted thereto. In some embodiments, the pawls 352 further comprise a stop that limits the range of motion so that it each pawl can rotate from a position against the respective tip 284 of the pusher member 282 to a position about 25°, or about 20° or 30° away from the tip 284 of the pusher member 282. However, any suitable range of motion may be set.

In FIG. 12A, the tip 284 of the pusher member 282 is beginning a generally downward path of motion. As the tip 284 travels, the tip is likely to engage accumulated sheet product 13 depicted by solid black line. However, the pawl 352 is also prone to engaging additional accumulated sheet product 13 at a location further and distal from the tip 284.

FIG. 12B shows the same dispensing cycle at a point later than in FIG. 12A. In FIG. 12B, the tip 284 has proceeded generally downward and the tip has engaged some accumulated sheet product 13 and pushed the sheet product toward the dispensing opening 18. Also, the pawl 352 has caught some of the accumulated sheet product 13. As the pusher member 282 moves generally downward, the pawl 352 has pivoted about its pivot point due to the sheet product's resistance motion, pivoting about 25° until it contacts a stop (not shown). By pivoting outward due to engaging the sheet product 13, the pawl 352 has thereby extended outward and engaged additional accumulated sheet product to remove such sheet product from the chute 16.

In FIG. 12C, the tip 284 and pawl 352 have removed the accumulated sheet product from the chute 16. The pusher member 282 is moving in a generally upward direction in FIG. 12C. The pawl 352 pivots to a position against the pusher member 282 due to gravity and/or due to any contact with the sheet product 13 that is moving in an opposite direction or otherwise due to any forces or contacts with objects that would help retract the pawl back to the pusher member 282.

Although the sheet product dispenser 350 illustrated in FIGS. 12A-12C comprises a pawl 352 and a tip 284 functioning together to remove bunched sheet product 13 from the chute 16, embodiments in which the pawl 352 is the only portion of the pusher member 282 that engages sheet product in the chute are within the scope of this disclosure.

Embodiments of this disclosure include, but are not limited to the following:

Clause 1. A sheet product dispenser for dispensing sheet product from a supply of sheet product, the dispenser comprising:

- a housing comprising a chute having a sheet product dispensing opening;
  - a sheet product feed roller assembly disposed in the housing and configured to feed sheet product from the supply of sheet product into the chute; and
  - a pusher disposed in the housing and configured to engage the sheet product fed from the sheet product feed roller assembly at a location downstream from the sheet product feed roller assembly and push the sheet product fed from the sheet product feed roller assembly toward the dispensing opening to reduce accumulation of the sheet product in the chute.

Clause 2. The sheet product dispenser of clause 1, wherein the pusher is configured to move into and out of engagement with the sheet product fed from the sheet product feed roller assembly.

Clause 3. The sheet product dispenser of clause 1, wherein the pusher is configured to selectively move into and, alternatively, move out of engagement with the sheet product fed from the sheet product feed roller assembly.

Clause 4. The sheet product dispenser of clause 1, wherein the pusher is configured to substantially continuously engage the sheet product fed from the sheet product feed roller assembly.

Clause 5. The sheet product dispenser of clause 2, wherein the pusher is configured to oscillate between a remote position in which the pusher is remote from the sheet product fed from the sheet product feed roller assembly and an engagement position in which the pusher can engage the sheet product fed from the sheet product feed roller assembly.

Clause 6. The sheet product dispenser of clause 1, wherein the pusher comprises one or more pusher members configured to engage the sheet product fed from the sheet product feed roller assembly.

Clause 7. The sheet product dispenser of clause 1, wherein the pusher comprises a rotatable pusher roller.

Clause 8. The sheet product dispenser of clause 7, wherein the rotatable pusher roller comprises one or more pusher members configured to engage the sheet product fed from the sheet product feed roller assembly.

Clause 9. The sheet product dispenser of clause 6, wherein at least one of the one or more pusher members is cylindrical.

Clause 10. The sheet product dispenser of clause 6, wherein at least one of the one or more pusher members is non-cylindrical.

Clause 11. The sheet product dispenser of clause 8, comprising a plurality of the one or more pusher members and wherein the plurality of pusher members are non-cylindrical.

Clause 12. The sheet product dispenser of clause 11, wherein the plurality of the one or more pusher members are aligned with one another on the rotatable pusher roller.

Clause 13. The sheet product dispenser of clause 11, wherein the plurality of the one or more pusher members are offset from one another on the rotatable pusher roller.

Clause 14. The sheet product dispenser of clause 8, wherein at least one of the one or more pusher members is elliptical.

Clause 15. The sheet product dispenser of clause 8, wherein the one or more pusher member comprises one or more high friction areas configured to engage the sheet product fed from the sheet product feed roller assembly.

Clause 16. The sheet product dispenser system of clause 15, wherein the one or more high friction areas comprise rubber.

Clause 17. The sheet product dispenser system of clause 14, wherein the one or more elliptical pusher members each comprise two opposing tips, each opposing tip comprising at least one high friction area configured to engage the sheet product fed from the sheet product feed roller assembly as the pusher roller rotates.

Clause 18. The sheet product dispenser system of clause 1, wherein the pusher comprises one or more conveyors.

Clause 19. The sheet product dispenser system of clause 18, wherein at least one of the one or more conveyors comprises a driven conveyor roller, an idle roller, and a conveyor belt configured to travel around the driven conveyor roller and idle roller and engage the sheet product fed from the sheet product feed roller assembly.

Clause 20. The sheet product dispenser of clause 1, wherein the pusher comprises a rotatable pusher roller comprising one or more elliptical pusher members configured to engage the sheet product fed from the sheet product feed roller assembly, wherein the one or more elliptical pusher members each comprise two opposing tips, each opposing tip comprising at least one high friction area configured to engage the sheet product fed from the sheet product feed roller assembly as the pusher roller rotates.

Clause 21. The sheet product dispenser system of clause 1, wherein the pusher comprises one or more pusher members configured to move into and out of engagement with the sheet product fed from the sheet product feed roller assembly.

Clause 22. The sheet product dispenser system of clause 21, wherein at least one of the one or more pusher members is configured to oscillate between a remote position in which the pusher member is remote from the sheet product fed from the sheet product feed roller assembly and an engagement position in which the pusher member can engage the sheet product fed from the sheet product feed roller assembly.

Clause 23. The sheet product dispenser of clause 21, wherein at least one of the one or more pusher members is configured to selectively move into and, alternatively, move out of engagement with the sheet product fed from the sheet product feed roller assembly.

Clause 24. The sheet product dispenser of claim 21, wherein the pusher comprises a plurality of the one or more pusher members.

Clause 25. The sheet product dispenser of clause 24, wherein the sheet product feed roller assembly has a length and the plurality of pusher members extend along the length spaced from one another facing the sheet product feed roller assembly and aligned with one another.

Clause 26. The sheet product dispenser of clause 24, wherein the sheet product feed roller assembly has a length and the plurality of pusher members extend along the length spaced from one another facing the sheet product feed roller assembly and are offset from one another.

Clause 27. The sheet product dispenser of clause 21, wherein at least one of the one or more pusher members comprises a tip configured to engage the sheet product fed from the sheet product feed roller assembly as the pusher engages the sheet product.

Clause 28. The sheet product dispenser of clause 21, wherein at least one of the one or more pusher members comprises a plurality of tips configured to engage the sheet product fed from the sheet product feed roller assembly as the one or more pusher members rotate.

Clause 29. The sheet product dispenser of clause 27, wherein at least one of the one or more pusher members comprises an arm and the arm comprises the tip.

Clause 30. The sheet product dispenser of clause 29, wherein the tip follows a path prescribed by a motion-generator.

Clause 31. The sheet product dispenser of clause 30, wherein the path is circular.

Clause 32. The sheet product dispenser system of claim 21, wherein each of the one of more pusher members comprises a tip and a slot distal from the tip and the dispenser system further comprises one or more stationary pins and one or more crank arms, the one or more pusher members configured with the one or more stationary pins and one or more crank arms such that, when the one or more crank arms are rotated, the one or more stationary pins guide each of the one or more pusher members in oscillation between a remote position in which the one or more pusher members are remote from the sheet product fed from the sheet product feed roller assembly and an engagement position in which the tip or tips of the one or more pusher members can engage the sheet product fed from the sheet product feed roller assembly.

Clause 33. The sheet product dispenser system of clause 27, wherein the tip comprises a high friction area.

Clause 34. The sheet product dispenser system of clause 33, wherein the tip comprises rubber.

Clause 35. The sheet product dispenser system of clause 21, wherein at least one of the one or more pusher members comprises a pawl.

Clause 36. The sheet product dispenser system of clause 21, wherein at least one of the one or more pusher members comprises a tip and a pawl pivotally mounted to the tip and is configured such that the pawl engages the sheet product fed from the sheet product feed roller assembly when the at least one of the one or more pusher members moves into engagement with the sheet product fed from the sheet product feed roller assembly.

Clause 37. The sheet product dispenser system of clause 1, wherein the chute further comprises one or more stationary chute members for guiding the sheet product fed from the sheet product feed roller assembly away from the sheet product feed roller assembly and toward the dispensing opening.

Clause 38. The sheet product dispenser system of clause 37, wherein the stationary chute members are spaced from one another along the sheet product feed roller assembly and the pusher comprises a plurality of pusher members configured to repeatedly move into and out of engagement with the sheet product fed from the sheet product feed roller assembly and disposed between respective ones of the stationary chute members.

Clause 39. The sheet product dispenser system of clause 1, further comprising one or more stationary stripper members disposed adjacent the sheet product feed roller assembly for guiding the sheet product fed from the sheet product feed roller assembly away from the sheet product feed roller assembly and into the chute.

Clause 40. The sheet product dispenser system of clause 1, further comprising a motor for operating the sheet product feed roller assembly.

Clause 41. The sheet product dispenser system of clause 1, further comprising a motor for operating the pusher.

Clause 42. The sheet product dispenser system of clause 1, further comprising a user driven mechanism for operating the sheet product feed roller assembly.

Clause 43. The sheet product dispenser system of clause 1, further comprising a user driven mechanism for operating the pusher.

Clause 44. The sheet product dispenser system of clause 1, wherein the sheet product feed roller assembly and the pusher are synchronized.

Clause 45. The sheet product dispenser system of clause 1, wherein the pusher moves faster than the sheet product feed roller assembly.

Clause 46. The sheet product dispenser system of clause 1, wherein the sheet product feed roller assembly comprises a drive roller and a pinch roller configured to form a nip therebetween for receiving the sheet product.

Clause 47. The sheet product dispenser system of clause 46, further comprising a motor for driving the drive roller and the pusher.

Clause 48. The sheet product dispenser system of clause 47, wherein the sheet product feed roller assembly and the pusher are synchronized.

Clause 49. The sheet product dispenser system of clause 46, wherein the pinch roller comprises roller segments having gaps between adjacent segments and the dispenser further comprises one or more stationary stripper members disposed adjacent the pinch roller and extending into the gaps for guiding the sheet product fed from the sheet product feed roller assembly away from the sheet product feed roller assembly and into the chute.

Clause 50. The sheet product dispenser system of clause 46, wherein the drive roller comprises roller segments having gaps between adjacent segments and the dispenser further comprises one or more stationary stripper members disposed adjacent the drive roller and extending into the gaps for guiding the sheet product fed from the sheet product feed roller assembly away from the sheet product feed roller assembly and into the chute.

Clause 51. The sheet product dispenser system of claim 1, further comprising a tear bar for cutting the sheet product fed from the sheet product feed roller assembly downstream of the sheet product feed roller assembly.

Clause 52. The sheet product dispenser system of clause 51 wherein the tear bar is disposed within and fixed to the housing and configured to cut the sheet product to form a cut sheet product for removal from the chute and leave any remaining sheet product fed from the sheet product feed roller assembly within the chute.

Clause 53. The sheet product dispenser system of clause 1, wherein the supply of sheet product is a roll of continuous sheet product.

Clause 54. The sheet product dispenser system of clause 1, wherein the supply of sheet product is a stack of discontinuous interfolded sheets.

Clause 55. The sheet product dispenser of clause 1, wherein:

the sheet product feed roller assembly comprises a drive roller and a pinch roller configured to form a nip therebetween for receiving the sheet product;

the dispenser further comprises a motor for operating the sheet product feed roller assembly and the pusher, the drive roller and the pusher being synchronized and the motor being configured such that the motor drives the drive roller and the pusher;

the chute further comprises one or more stationary chute members spaced from one another along the sheet product feed roller assembly for guiding the sheet product fed from the sheet product feed roller assembly away from the sheet product feed roller assembly and toward the dispensing opening;

the pusher comprises a rotatable pusher roller comprising a plurality of elliptical pusher members configured to repeatedly move into and out of engagement with the sheet product fed from the sheet product feed roller assembly and disposed between respective ones of the stationary chute members, wherein the plurality of elliptical pusher members each comprise two opposing tips, each opposing tip comprising at least one high friction area configured to engage the sheet product fed from the sheet product feed roller assembly as the pusher roller rotates; and the dispenser further comprises a tear bar that is disposed within and attached to the housing and configured to cut the sheet product to form a cut sheet product for removal from the chute and leave any remaining sheet product fed from the sheet product feed roller assembly within the chute.

Clause 56. The sheet product dispenser of clause 1, wherein:

the pusher comprises one or more pusher members configured to move back and forth between a remote position in which the pusher member is remote from the sheet product fed from the sheet product feed roller assembly and an engagement position in which the pusher member can engage the sheet product fed from the sheet product feed roller assembly;

the dispenser further comprises a motor for operating the sheet product feed roller assembly and the pusher, the drive roller and the pusher being synchronized and the motor being configured such that the motor drives the drive roller and the pusher; and the dispenser further comprises a tear bar that is disposed within and attached to the housing and configured to cut the sheet product to form a cut sheet product.

Clause 57. The sheet product dispenser system of clause 56 wherein each of the one or more pusher members comprises an arm having a tip and the one or more pusher members are configured such that the tip or tips of the one or more pusher members can engage the sheet product fed from the sheet product feed roller assembly.

Clause 58. The sheet product dispenser system of clause 57 wherein the tip of each of the pusher member arms extends into the chute along at least a portion of the feed roller assembly for engaging any of the sheet product accumulated in the chute to push the sheet product through the chute and toward the dispensing opening.

Clause 59. A method for dispensing sheet product from a supply of sheet product comprising the steps of:

feeding a sheet product from the supply of sheet product into a chute with a sheet product feed roller assembly; and engaging the sheet product fed from the sheet product feed roller assembly at a location downstream from the sheet product feed roller assembly with a pusher disposed in the housing so as to push the sheet product fed from the sheet product feed roller assembly toward the dispensing opening to reduce accumulation of the sheet product in the chute.

Clause 60. The method of clause 59, wherein the engaging step comprises moving the pusher into and out of engagement with the sheet product fed from the sheet product feed roller assembly.

Clause 61. The method of clause 57, wherein the engaging step comprises selectively moving the pusher into and, alternatively, out of engagement with the sheet product fed from the sheet product feed roller assembly.

Clause 62. The method of clause 57, wherein the engaging step comprises substantially continuously engaging the pusher with the sheet product fed from the sheet product feed roller assembly.

Clause 63. The method of clause 58, wherein the step of engaging further comprises oscillating the pusher between a remote position in which the pusher is remote from the sheet product fed from the sheet product feed roller assembly and an engagement position in which the pusher can engage the sheet product fed from the sheet product feed roller assembly.

Clause 64. The method of clause 58, wherein the pusher comprises a rotatable pusher roller and the engaging step comprises rotating the rotatable pusher roller.

Clause 65. The method of clause 62, wherein the rotatable pusher roller comprises one or more pusher members and the engaging step further comprises engaging the sheet product fed from the sheet product feed roller assembly with the one or more pusher members.

Clause 66. The method of clause 65, comprising a plurality of the one or more pusher members.

Clause 67. The method of clause 57, wherein the pusher comprises one or more pusher members and the engaging step comprises moving at least one of the one or more pusher members into and out of engagement with the sheet product fed from the sheet product feed roller assembly.

Clause 68. The method of clause 67, wherein the engaging step further comprises oscillating at least one of the one or more pusher members between a remote position in which the pusher is remote from the sheet product fed from the sheet product feed roller assembly and an engagement position in which the pusher engages the sheet product fed from the sheet product feed roller assembly.

Clause 69. The method of clause 67, wherein the engaging step further comprises selectively moving at least one of the one or more pusher members into and, alternatively, moving out of engagement with the sheet product fed from the sheet product feed roller assembly.

Clause 70. The method of clause 67, wherein the pusher further comprises a plurality of the one or more pusher members and the engaging step comprises repeatedly moving the plurality of the one or more pusher members into and out of engagement with the sheet product fed from the sheet product feed roller assembly.

Clause 71. The method of clause 67, wherein the feeding step comprises operating the sheet product feed roller assembly with a motor.

Clause 72. The method of clause 67, wherein the feeding step comprises operating the pusher with a motor.

Clause 73. The method of clause 57, wherein the feeding step comprises operating the sheet product feed roller with a user driven mechanism.

Clause 74. The method of clause 57, wherein the feeding step comprises operating the pusher with a user driven mechanism.

Clause 75. The method of clause 59, wherein the feeding and engaging steps are synchronized.

Clause 76. The method of clause 59, wherein the engaging step comprises moving the pusher faster than the sheet product feed roller assembly.

Clause 77. The method of clause 59, further comprising the step of cutting the sheet product fed from the sheet product feed roller assembly downstream of the sheet product feed roller assembly with a tear bar.

The embodiments described hereinabove are useful for absorbent sheet product, such as wipers, paper towels, tissues, or napkins; however, embodiments of this disclosure are also applicable to conveyance of other flexible sheet products such as communication paper or flexible packaging material or the like. The conveyance may be achieved by equipment such as converting machines, fax machines, copy machines, money counters, and the like. Furthermore, the embodiments described in this disclosure have included a tear bar; however, this disclosure is also applicable to embodiments that do not use a tear bar, but that still benefit from a chute pusher helping to reduce or prevent sheet product bunching or jamming. Although this disclosure describes ways in which a chute pusher can remove sheet product bunching in order to prevent jams, some embodiments can also be used to remove paper that has already jammed a dispenser, thereby returning the dispenser to an operable condition. Therefore, this disclosure does not limit this invention to only preventable use, and the ability of embodiments of this disclosure in preventing jamming also incorporates the ability of embodiments to remove jamming that may have already incurred and may have incapacitated the dispenser.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific sheet product dispenser configurations, it will be appreciated that numerous other sheet product dispenser configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

I claim:

1. A sheet product dispenser for dispensing sheet product from a supply of sheet product, the dispenser comprising:

a housing comprising a chute having a sheet product dispensing opening;

a sheet product feed roller assembly disposed in the housing and configured to feed sheet product from the supply of sheet product into the chute;

a pusher disposed in the housing and configured to substantially continuously engage the sheet product fed from the sheet product feed roller assembly at a location downstream from the sheet product feed roller assembly and push the sheet product fed from the sheet product feed roller assembly toward the dispensing opening to reduce accumulation of the sheet product in the chute, and a tear bar for cutting the sheet product fed from the sheet product feed roller assembly downstream of the sheet product feed roller assembly.

2. The sheet product dispenser of claim 1, wherein the pusher comprises one or more pusher members configured to engage the sheet product fed from the sheet product feed roller assembly.

3. The sheet product dispenser of claim 2, wherein at least one of the one or more pusher members is cylindrical.

4. The sheet product dispenser of claim 3, wherein the at least one of the one or more pusher members are a plurality of pusher members, the pusher comprises a pusher roller, and the plurality of the one or more pusher members are aligned with one another on the rotatable pusher roller.

5. The sheet product dispenser of claim 2, wherein the at least one of the one or more pusher members are a plurality of pusher members, the sheet product feed roller assembly has a length, and the plurality of pusher members extend along the length spaced from one another facing the sheet product feed roller assembly and aligned with one another.

6. The sheet product dispenser of claim 1, wherein the pusher comprises a rotatable pusher roller.

7. The sheet product dispenser system of claim 1, wherein the pusher comprises one or more conveyors.

8. The sheet product dispenser system of claim 7, wherein at least one of the one or more conveyors comprises a driven conveyor roller, an idle roller, and a conveyor belt configured to travel around the driven conveyor roller and idle roller and engage the sheet product fed from the sheet product feed roller assembly.

9. The sheet product dispenser system of claim 1, further comprising one or more stationary stripper members disposed adjacent the sheet product feed roller assembly for guiding the sheet product fed from the sheet product feed roller assembly away from the sheet product feed roller assembly and into the chute.

10. The sheet product dispenser system of claim 1, wherein the sheet product feed roller assembly and the pusher are synchronized.

11. The sheet product dispenser system of claim 1, wherein the pusher moves faster than the sheet product feed roller assembly.

12. The sheet product dispenser system of claim 1, wherein the supply of sheet product is a roll of continuous sheet product.

13. The sheet product dispenser system of claim 1, wherein the chute further comprises one or more stationary chute members for guiding the sheet product fed from the sheet product feed roller assembly away from the sheet product feed roller assembly and toward the dispensing opening.

14. The sheet product dispenser system of claim 1, further comprising a motor for operating the sheet product feed roller assembly or the pusher.

15. The sheet product dispenser system of claim 1, wherein the sheet product feed roller assembly comprises a drive roller and a pinch roller configured to form a nip there between for receiving the sheet product.

16. The sheet product dispenser system of claim 15, further comprising a motor for driving the drive roller and the pusher.

17. The sheet product dispenser system of claim 15, wherein the pinch roller or drive roller comprises roller segments having gaps between adjacent segments and the dispenser further comprises one or more stationary stripper members disposed adjacent the pinch roller and extending into the gaps for guiding the sheet product fed from the sheet product feed roller assembly away from the sheet product feed roller assembly and into the chute.

18. A method for dispensing sheet product from a supply of sheet product comprising the steps of:

feeding a sheet product from the supply of sheet product past a tear bar and into a chute with a sheet product feed roller assembly; and substantially continuously engaging the sheet product fed from the sheet product feed roller assembly at a location downstream from the sheet product feed roller assembly with a pusher disposed in the housing so as to push the sheet product fed from the sheet product feed roller assembly toward the dispensing opening to reduce accumulation of the sheet product in the chute until the sheet product has been dispensed from the chute and a user can grasp the sheet product and tear it against the tear bar.

* * * * *